166-308. SR
1-20-76 OR 3,933,205

United States Patent [19]
Kiel

[11] 3,933,205
[45] Jan. 20, 1976

[54] HYDRAULIC FRACTURING PROCESS USING REVERSE FLOW

[76] Inventor: Othar Meade Kiel, c/o Intercomp Resource Development and Engineering, Inc., 2000 W. Loop S., Houston, Tex. 77027

[22] Filed: Jan. 27, 1975

[21] Appl. No.: 544,411

Related U.S. Application Data

[63] Continuation-in-part of Ser. No. 404,691, Oct. 9, 1973.

[52] U.S. Cl. ..... 166/308; 166/283
[51] Int. Cl.[2] ..... E21B 43/02; E21B 43/26
[58] Field of Search ..... 166/308, 271, 280, 278, 166/281, 283, 259, 249, 299

[56] References Cited

UNITED STATES PATENTS

| | | | |
|---|---|---|---|
| 2,769,497 | 11/1956 | Reistle, Jr. | 166/308 |
| 2,915,122 | 12/1959 | Hulse | 166/249 |
| 3,048,226 | 8/1962 | Smith | 166/177 X |
| 3,189,092 | 6/1965 | Bodine | 166/249 |
| 3,245,470 | 4/1966 | Henry | 166/280 |
| 3,302,720 | 2/1967 | Brandon | 166/249 |
| 3,378,074 | 4/1968 | Kiel | 166/308 |
| 3,592,266 | 7/1971 | Tinsley | 166/308 X |
| 3,710,865 | 1/1973 | Kiel | 166/308 |
| 3,722,595 | 3/1973 | Kiel | 166/308 |
| 3,743,017 | 7/1973 | Fast et al. | 166/308 X |

OTHER PUBLICATIONS

Stearns et al., "Reservoirs in Fractured Rock," AAPG Memoir No. 16, Stratigraphic Oil & Gas Classification Methods and Case Histories, 1972, pp. 82–106.

*Primary Examiner*—Stephen J. Novosad
*Attorney, Agent, or Firm*—Murray Robinson; Ned L. Conley; David Alan Rose

[57] ABSTRACT

Well productivity is increased by multiple hydraulic fracturing cycles. A double cycle first creates a long primary fracture by fluid injection and forms spalls by subsequently allowing the pressure in the fracture to drop below the initial fracturing pressure by discontinuing injection and shutting the well in or allowing it to flow back, resuming injection to displace said spalls longitudinally in said fracture and again discontinuing injection, whereupon the fracture is propped open by the displaced spalls.

Multiple applications of this double cycle successively create transversely directed secondary long fractures. Fracture extension and fluid loss is controlled by the sandout of fine spalls at terminal ends of the fractures, supplemented when necessary by the injection of sand of selected size to filter pack the natural joint system and, in some instances, to filter pack the vertical downward extent of joints and fractures thus limiting further fractures to the upper portion of the producing formation where upward leakage is inhibited by the overburden.

50 Claims, 15 Drawing Figures

Fig. 3

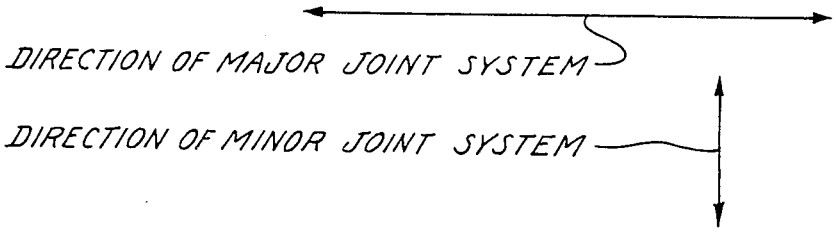

LOOKING DOWN ON A VERTICAL FRACTURE AS IT IS BEING FORMED, THE FRACTURE MAY FORM AS :

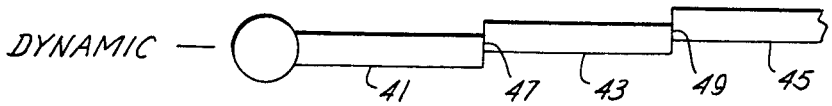

AFTER FLUID PRESSURE IS GONE, THE FRACTURE WILL BE FRAC SAND FILLED, BUT SHUT OFF AT INTERSECTIONS OF MAJOR AND MINOR JOINT SYSTEMS.

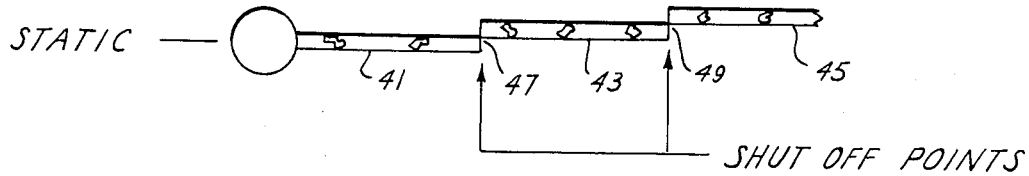

Fig. 4

LOOKING OUT HORIZONTALLY AT THE FACES OF A VERTICAL FRACTURE FROM THE WELL BORE :

UNDER DYNAMIC FLUID PRESSURE

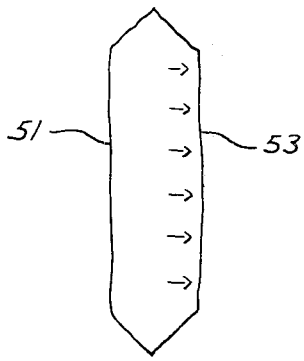

AFTER PUMPS ARE SHUT DOWN OR NEARLY SHUT DOWN

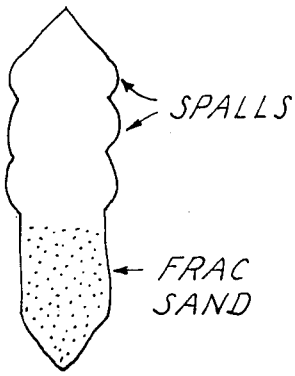

| PERMEABILITY | TIME — DAYS | |
|---|---|---|
| $k_{NF}$ md | 320 AC. TRACT | 640 AC. TRACT |
| 10 | 37 | 74 |
| 50 | 7 | 15 |
| 100 | 4 | 8 |

WAVE FRONT ARRIVALS

Fig. 12

COMPARISON OF FRACTURING TREATMENTS

| | UNINTENTIONAL SHUT DOWN | | CONVENTIONAL | | |
|---|---|---|---|---|---|
| TYPE OF TREATMENT | NUMBER OF WELLS | BOPD | NUMBER OF WELLS | BOPD * | YEARS TESTED |
| VISOFRAC | 5 | 19.80 | 4 | 7.60 | 2 |
| SUPERFRAC | | | 4 | 8.71 | 2 |
| GELLED F.W. | 4 | 13.46 | 5 | 11.20 | 2 |
| GELLED S.W. | 5 | 23.72 | 7 | 11.54 | 1 |
| F.W. EMULSION | 7 | 37.14 | 12 | 8.69 | 2 |
| S.W. EMULSION | 4 | 27.27 | 6 | 9.50 | <3 MO. |

* BOPD = BARRELS OIL PER DAY, AVERAGE

HYDRAULIC FRACTURING PROCESS USING REVERSE FLOW

CROSS REFERENCE TO RELATED APPLICATIONS

The present application is a continuation-in-part of the applicant's copending U.S. application Ser. No. 404,691, filed Oct. 9, 1973, now abandoned, of which application serial number 593540 filed July 7, 1975 is a continuation. The invention of the parent application is referred to in an article in Western Oil Reporter, Summer, 1973, June 1973, page 13, entitled New Kiel Stimulation Process Lauded as Tool to Frac Tight Gas Formations, said article having been prepared by the present applicant and his wife in response to an inquiry.

BACKGROUND OF THE INVENTION:

1. Field of the Invention:

This invention relates to hydraulic fracturing of earth formations, and more particularly to the hydraulic fracturing of HC (hydrocarbon) bearing formations, e.g. oil and gas sands, for the purpose of increasing the producing rate and total amount of recovery of the hydrocarbons from a well completed in such a formation, and, in the case of storage wells, for the purpose of increasing the injection rate and total capacity.

2. Brief Description of the Prior Art:

The hydraulic fracturing of HC formations is well known and is described for example in the following United States patents number:

3263751 - Kiel et al.
3376930 - Kiel et al.
3373815 - Kiel et al.
3378074 - Kiel
339727 - Graham & Kiel
3444889 - Kiel et al.
3497008 - Graham & Kiel
3553494 - Kiel
3601198 - Ahearn & Kiel
3664420 - Graham, Kiel & Terry
3695355 - Wood & Kiel
3700032 - Terry, Graham, Sinclair & Kiel
3722595 Kiel and in the references cited against the above listed patents. Further description of the subject is to be found in an article entitled "Reservoirs in Fractured Rock" by Stearns and Friedman appearing at pages 82 et seq. of AAPG Memoir No. 16 *Stratigraphic Oil & Gas Classification Methods and Case Histories* - 1972 and the bibliography appended thereto.

The function of fracturing is to overcome the deficiency in permeability of the formation adjacent the well bore by creating a highly conductive path reaching out into the reservoir rock surrounding the well bore. According to the usual practice, a fluid such as water, oil, oil/water emulsion, gelled water, or gelled oil, is pumped down a well bore with sufficient pressure to open a fracture in the HC formation. The fluid may carry a suitable propping agent, such as sand, into the fracture for the purpose of holding the fracture open after the fracturing fluid has been recovered, e.g. allowing the well to flow. A normal fracture treatment consists of one continuous injection of fluid. In the case of tight, i.e. low permeability wells, i.e. below 1 md permeability, fracturing produces results that are of but a temporary nature as far as increasing rate of flow is concerned and little or no increase in total recovery is achieved. After perhaps a short period of accelerated flow, rate of production may drop off to near previous levels. Repeated stimulation with the same or similar procedure may again produce but a temporary gain.

Prior to the present invention, a conductive fracture extending radially one hundred fifty feet from the well bore was believed to be about the maximum obtainable.

The reason for the temporary increase in productivity produced by the prior art is believed to be that the fracture communicates the well bore with a small portion of the joint system between the matrix elements of the formation and with a small portion of the reservoir matrix. However, as soon as this low volume space has been drained, productivity drops off to that controlled by the low permeability reservoir matrix, and since the area exposed to such matrix by a short fracture is low, productivity is low.

Hydraulic fracturing procedure usually has best results in formations of moderate permeability, e.g. one to twenty millidarcies. In order to achieve satisfactory production from a formation of low permeability, e.g. below one millidarcy, it has been the belief of experts that a much longer fracture than that heretofore attainable is necessary.

SUMMARY OF THE INVENTION

According to the invention, significant prolonged increases in flow rate of several hundred percent above normal flow are attained and maintained. This is accomplished by employing one or more of the following procedures:

a. A single treatment including at least one double cycle of high pressure, low pressure, high pressure and low pressure.

b. A single treatment includes one double cycle, followed by a second double cycle.

c. A single treatment of two double cycles is followed by a third double cycle, et cetera.

Otherwise stated, according to the invention there are scheduled periods when injection is terminated and the well shut in or allowed to flow back to cause low fracture pressure to produce spalling, and there are plural periods of injection of fracturing fluid to move the spalls into propping position, to sandblast clear any fracture restrictions, and to sand out prior fractures in order to initiate secondary fractures transverse to the original.

In the case of an extremely thick section, e.g., in excess of fifty feet of uniform sand body, for the purpose of controlling loss of fracturing fluid to the formation, sand or other material of various sizes may be added to the fracturing material, and the vertical extent of the well bore treated thereby confined to the upper portion of the producing formation.

Further objects and advantages of the invention will become apparent from the further description appearing hereinafter.

BRIEF DESCRIPTION OF THE DRAWINGS

For a detailed description of preferred embodiments of the invention reference will be made to the following drawings wherein:

FIGS. 3 and 4 are diagrams illustrating possible reasons for failure of conventional hydraulic fracturing producing very long fractures;

FIG. 12 is a chart comparing well productivities; and

DESCRIPTION OF PREFERRED EMBODIMENTS

A. Prior Art — No Fracture

Figure 1:
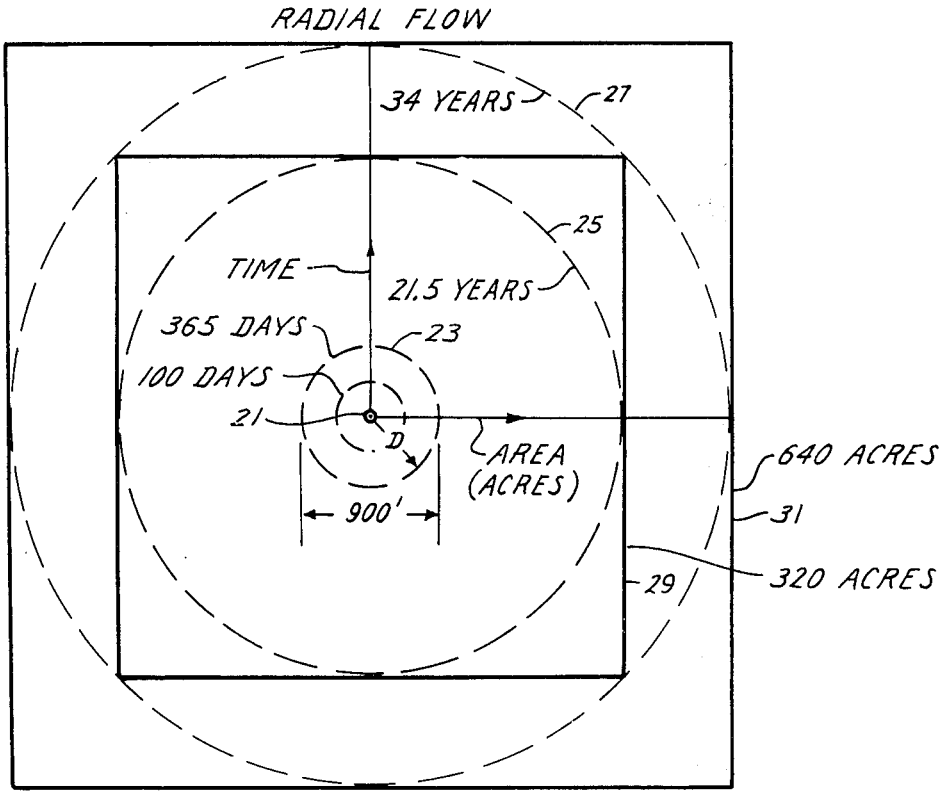
FIG. 1 is a plan view of a well site showing graphically the time of travel of a transient pressure wave front versus radial distance from the well bore, the well being a tight (low permeability) well and having been completed by conventional perforation without stimulation.

According to reservoir engineering theory, the time for a pressure disturbance, e.g., a pressure drop initiated by producing a well, to be propagated radially through an earth formation from the well bore, may be determined by the following equation:

$$t_D = 40\phi u c D^2/k \quad (1)$$

where $t_D$ = diffusion time to radius D (days)

$\phi$ = porosity (fractional)

$u$ = Reservoir fluid viscosity (centipoise)

$c$ = Reservoir fluid (gas) compressibility in $psi^{-1}$)

D = Distance to which the pressure disturbance has been propagated measured radially from the well bore (feet).

$k$ = permeability (millidarcies)

Reservoir engineering theory and practice further indicate that the time T to drain the volume within the radius D of the well bore is given approximately by the equation:

$$T = 20\, t_D \quad (2)$$

Twenty years is a desirable (economic maximum) drainage time for a well. If T=20 years, $t_D$=20/20 = 1 year, or 365 days, so that at the end of one year the wave front will reach the distance $D_{20}$ drained in twenty years. Therefore $$D^2_{20} = 9.125k/\phi uc \quad (3)$$

From equation (3) one can calculate the area encompassed by radius $D_{20}$. By using the area encompassed and the reservoir thickness, the volume of reservoir rock drainable in a 20 year period, the conventional period of the production life of a well for any particular type of formation, can be calculated.

Assuming that $\phi = 0.1$ $u = 0.02$ cps $c = 1/1500$ psi $k = 0.03$ md one finds that $$D_{20} = 450 \text{ feet.}$$

In other words, for the pressure wave front to reach just a 450 foot radius or 14.6 acre area, in such a tight formation takes a whole year, and it takes twenty years to drain such a small volume. Similar calculations show that the pressure wave will take 21.5 years to reach the perimeter of a 320 acre square centered on the well bore and that the volume extending horizontally over such an area would be drainable in 430 years. The wave would take 34 years in the case of a 640 acre tract (one square mile) which would be drainable in 680 years.

The foregoing is shown schematically in FIG. 1 wherein there is shown well bore 21 and 1, 24.5, and 34 year wave fronts, 23, 25, 27 and the perimeters 29, 31 of 320 and 640 acre tracts.

It will be apparent from the foregoing that in order to produce a field of such low permeability within a twenty year period the well spacing would have to be 900 feet, i.e., a well density of 43 wells per square mile. This shows the impracticality of economically producing a well in such tight formation without special productive techniques.

B. Conventional Short Fractures

Figure 2:
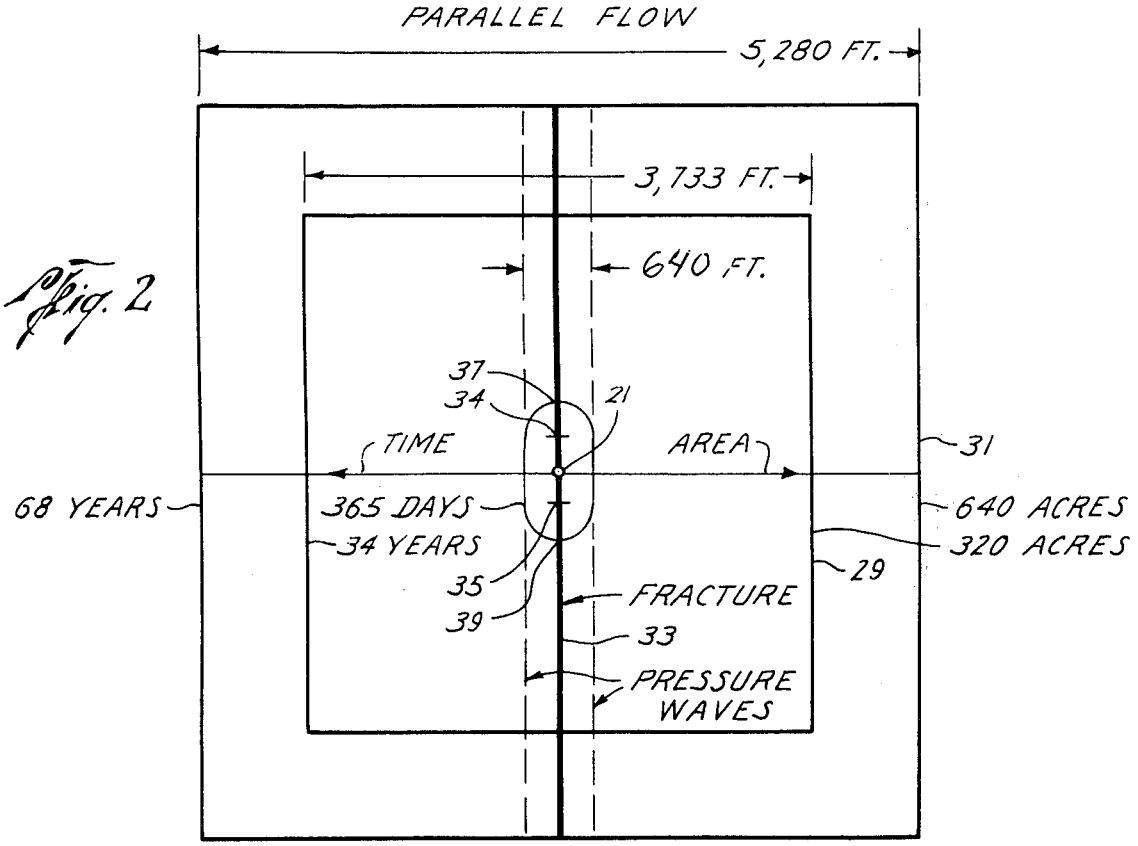
FIG. 2 is a similar plan view showing the results of conventional fracturing and of an improved form of fracture in accordance with one form of the present invention.

Referring now to FIG. 2 there is shown schematically the situation existing in the case of a producing formation that has been processed in accordance with hydraulic fracturing techniques to create a single highly conductive fracture along line 33 extending from the well bore 21 in both directions. In this situation we are no longer dealing with radial propagation of the pressure wave nor radial flow. Because of the highly conductive fracture, it may be assumed that pressure throughout the fracture plane is substantially equal to that at the well bore. The pressure disturbance created in the formation by producing the well creates a pair of planar wave fronts parallel to the fracture plane. D is now the distance measured perpendicularly from the fracture and $t_D$ is the time for the wave front to reach distance D.

The other parameters are as before. The equation for $t_D$ is:

$$t_D = 80\phi(u)(c)(D)^2/k \quad (4)$$

If, as before, one assumes that the time T to drain a volume within a distance D from the fracture (including both sides of the fracture) is given by the equation:

$$T = 20t_D \quad (5)$$

then:

$$D^2 = 4.5625k/\phi uc \quad (6)$$

Using the same parameters as before $$D_{20} = 320 \text{ feet.}$$

Let (L) be the length of the hydraulic fracture and A be the area of a horizontal section of the volume drained in twenty years. Then $$A = (2)(320)(L)/43560 = 0.0147(L) \text{ acres.} \quad (7)$$

In the case of a conventional fracture of say 150 feet in each direction from the well bore, indicated on FIG. 2 by the line segment between points 34 and 35, the area drained would include the rectangular area computed as before $$A = .0147(L)$$

or $$A = .0147(300) = 4.41 \text{ acres}$$

plus the two semi-circular end areas indicated at 37, 39 whose total area is 14.8 acres, for a total of 19.2 acres, corresponding to a density of 33.3 wells per square mile for 100% drainage. While this is better than the 43 wells per square mile for an unfractured well, it is probably non-commercial and is greatly inferior to the results achieved with long fractures made in accordance with the present invention.

C. Long Fractures

According to the present invention a long fracture is obtained by interrupting a conventional fracturing operation somewhere between the beginning and end of the injection period, preferably during the last ⅓ – ¼ of the fluid injected. During the shut down period, that is, when the pumps are shut down and the flow rate and fluid friction of the injection fluid drops to zero, the pressure in the fracture is reduced to the sum of the hydrostatic head plus the surface instantaneous shut in pressure. The lowering of pressure at the fracture face causes the formation to spall at the fracture face. The spalls remain in place until flow is resumed by starting the pumps again. When flow is resumed, the spalls are displaced by the fluid and carried along a greater or lesser distance according to the size of the spall and the width of the fracture. These spalls will maintain the fracture propped open to nearly its maximum width, and at the same time the advancing pumped fluid will increase the fracture length.

If the fracture length is 3733 feet (the length of one side of a 320 acre tract).

A = 54.8 acres and if the fracture length is 5280 feet (the length of one side of a square mile tract),
A = 77.6 acres.

These are to be compared with the 15 acres drained without a fracture and the 19.2 acres with a conventional or short fracture.

With a long fracture as shown in FIG. 2 it would be practical to space wells with a density of 11.66 per square mile in the case of a fracture extending the length of a half square mile tract, and 5.7/square mile in the case of a one mile fracture. This of course would be much more economical than in the case of an unfractured well where the required density was 43 wells per square mile, or the case of wells with short fracture requiring 33.3 wells per square mile.

D. Recap: Short & Long Fractures

In order to obtain sustained high productivity from an oil or gas well, it is necessary to produce a relatively long, highly conductive fracture. The lower the permeability of the formation, the longer the fracture must be. However, as the fracture length increases there is a greater and greater chance that the conductive path can be altered so that not all of the generated length will remain connected to the well bore after the fracture fluid is recovered. Some of the reasons that the full length would not be utilized are illustrated in FIGS. 3 and 4.

Referring to FIG. 3 it is seen that a hydraulic fracture initially, that is, in the dynamic condition while the fracture is being formed, probably includes a plurality of relatively long straight fractures 41, 43, 45 joined by a plurality of short transverse fractures 47, 49 which interconnect the long fracture. In the static condition, the fracture consists of the same plurality of long fractures, 41, 43, 45, held open by the fracture sand to a limited degree, but the transverse fractures 47, 49 no longer interconnect the long fractures, the overlap of the long fracture at their ends disappearing as the fracture width diminishes, the transverse fractures shutting off the longitudinal fractures like valves.

Referring now to FIG. 4, it is seen that initially, that is, during fracture fluid injection, the walls 51, 53 of the fracture are held apart and the space therebetween is filled with fluid or sand laden fluid which is free to move. However after the fracturing operation has been completed, the spalls and related fines generated during fracturing will gradually fill the open spaces in the fracture. This will effectively shut off highly conductive channels when the well is put on production.

In order to insure that fluid flow is not shut off when the well is put on production either by the fracture closing at the intersection of joints or by the gradual blocking of the fracture by spalls and fines, the method of the invention, previously set forth briefly, is employed, as follows:

After an initial fracturing has occurred during the frac job, at calculated intervals, the pumps are shut down and the well is shut in or allowed to flow back to reduce the fluid pressure in the fracture to below the fluid pressure in the surrounding matrix of the formation. This reduction of fluid pressure in the fracture and flow of fluid from the matrix to the fracture causes earth stress next to the fracture to form spalls at the fracture face. The pumps are then started up again to regular fracturing rate with a corresponding increase in pressure. Fluid flow and pressure forces the face of the fracture apart and allows — or forces — the spalls to move out of their original position and be driven into the generated width of the fracture where they will remain supporting the earth forces that would tend to close the fracture when pumping ceases.

There will be a concomitant generation of "fines" (small particles of formation) generated when the spalls move. These fines will have a tendency to sand blast any great restriction in the fracture to keep it at maximum conductivity and in addition be swept out toward the end of the fracture where they will not be able to reduce fracture conductivity closer to the well bore.

It may or may not be necessary to use frac sand in the fluid to obtain desired results. If such sand is used, its primary function will be that of a fluid loss prevention system.

E. Historical Investigation

Analysis of data from fracturing reports relative to well treatments that have been performed in the past five years on a series of wells in the same formation in the same geographical area shows that a recent two months production of wells that had inadvertently been shut down because of mechanical failure of equipment during the frac job compared to wells that had not been shut down (i.e., had run according to frag plan) show a marked difference in production.

Twenty-one wells that had had a shut down period during fracturing on the particular months chosen averaged about $2018 gross production each.

Thirty-six wells that had been run according to plan without the shut down averaged $783 gross production each.

F. Experimental Test

A group of wells was then selected that used the same fracturing schedule as a previous group, but an intentional shut down period of one hour was put in the frac plan. This was done in the summer of 1972.

First month's production was about double compared to when no shut down period was used. It was then decided that more tests were required to determine if this increase in production would continue over a longer term.

When the shut down period was used, the wells would flow back treating fluid of about ½ the volume injected, approximately the same as with no shut down period.

The applicant then engaged in a period of systematic experimental tests lasting slightly over one year (until February 1974). During this period applicant experimentally treated approximately 40 wells, including both oil and gas wells. This program was carried out under strict secrecy agreements with both the well operators and the service companies that provided men and equipment to carry out the present invention's method of hydraulic fracturing. The agreements with the well operators provide that the operators must furnish the applicant with production information on treated wells, both before and after treatment, so the applicant will be able to assess the effects of the present invention. A production history of a year or longer is necessary to assess quantitatively the flow characteristics of a treated well. This is because most wells show an initial, short term (i.e. a few months), increase in productivity when they are treated by conventional fracturing methods. The fractures produced by conventional methods, however, tend to close up, as described above, and production declines sharply. An improvement taught by the present invention is the long term increase in productivity it accomplishes via dendritic fracturing of the formation. To determine quantitively if this desired result had been realized, an experimental period of a year or more is required.

Applicant performed experimental treatments while he was in the business of providing well treatment services of oil well operators. Experimental treatment of operating wells was necessary because the program of experimental tests required that a variety of formations be treated and that a substantial production history of each formation be available for comparison with production after treatment.

The following table sets forth a representive sample of the results obtained from the experimental tests conducted from January 1973 to July 1974.

PRESENT INVENTION AND CONVENTIONAL FRACTURING METHODS COMPARED IN UNITED STATES PETROLEUM BASINS

| Example No. | Basin/ State | Formation | Age | Flow Back | Fluid | Number of Tests | Cost $ | Typical Sand lbs. | Fluid Bbls. | Depth Ft. | Thickness Gross Ft. | Thickness Net Ft. |
|---|---|---|---|---|---|---|---|---|---|---|---|---|
| 1 | Appalachian /Ohio | Clinton | Silurian | ome | W. | 3 | 8,500 | 37,000 | 3,000 | 5,000 | 50 | 30 |
| 2 | Fort Worth /Texas | Conglomerate | Penn. | ome | E. | | 4,500 | 52,000 | 1,500 | 4 to 5,000 | 10–30 | 2–20 |
| 3 | Permian /Texas | Canyon | Penn. | All | W. | 2 | 12,000 | 37,000 | 3,000 | 5,000+ | 30–50 | 30–50 |
| 4 | Uinta /Utah | Dakota | Cret. | All | W. | 1 | 15,000 | 37,000 | 3,000 | 9,400+ | 36 | 36 |
| 5 | Gulf Coast /Texas | Wilcox | Cret. | All | E. | 1 | 10,000 | 37,000 | 1,500 | 8,000+ | 12 | 3 |
| 6 | East Texas /Texas | Hosston Equiv. Travis Peak | Cret. | No | E. | 1<br>1 | 11,000<br>24,000 | 48,000<br>80,000 | 1,500<br>4,5000 | 8,000+<br>8,000 | 20<br>50–70 | 15<br>40–50 |
| 7 | Denver-Julesberg /Colorado | Muddy | Cret. | No | E. | 4 | 18,000 | 150,000 | 4,500 | 7,000 | 50–60 | 20–40 |
| 8 | Carlsbad Field/ New Mexico | Morrow | Penn. | No. | E. | 1 | 32,000 | 150,000 | 4,500 | 11,000 | —* | —* |
| 9 | Gulf Coast /Texas | Austin Chalk | Cret. | All | W. | 1 | 8,400 | 150,000 | 9,000 | 2–3,000 | 200–600 | 200+ |

*No Reservoir Discernible in Well Bore (well has offsetting production)

| Ex. No. | % | K md | Approx. Formation Temp. / Press. | Lithology | Average Conventional Fracturing* Mcf/D | (dendritic fracturing) Present Invention Before Mcf/D | After Mcf/D | Remarks |
|---|---|---|---|---|---|---|---|---|
| 1 | 7–8 | .002 | 110 / 12–1,300 | ss | 100–200 | 5–10 | 600+ | |
| 2 | 10–14 | N.A. | 110–20 / 16–1,800 | ss & Lm | 0–500<br>0–20 Bbl | 0–50 | 400–3,000<br>20–80 Bbl | 3 of 8 were refraced dry holes |
| | 10–12 | .02–3 | 140 / 1,800 | ss | 600–1,000 | 0–300 | 2–3.5 M | |
| 4 | 12–18 | .02–3 | 207 / 2,200+ | ss | Not economic | 5 | 1,000 | |
| 5 | 16–18 | 0.1–1 | 200 / 2,200 | ss | Variable- | 300 at 800 psi | 2.4M at 800psi | |
| | 16–18 | 0.1–1 | 200 / 2,200 | ss | good to uneconomic | 1300 at 800psi | 2.3M at 800psi | |
| 6 | 8–10 | .05–.1 | 250 / 2,500 | ss | Poor to uneconomic | Slight gas | Water | |
| 7 | 8–10 | .02–3 | 250 / 1,800 | ss | Not economic | Slight | 1.5–2M 1 Bbl Water/MMcf | |
| | — | — | 250 / 4,000 | ss | Unsatisfactory Except for removal of well bore damage | 0 | 0 | Dry Hole |
| 9 | 18–22 | .1 | 100 / 100–1,000 | Ls | 8 BOPD | 3 BOPD<br>6 BWPD | 16 BOPD<br>30–40 BWPD | Refrac |

*From well histories of similar formations after conventional fracturing. Applicant did not preform conventional fracturing on these jobs.

It will be noted that test No. 8 was a dry hole and that test No. 6 yielded water. However, in tests No. 1, 2, 3, 4, 5 and 9 the present invention yielded increases in production of from 200 to 500% over conventional fracturing processes.

In February of 1974 the inventor was able to conclude, as a result of the experimental program of well treatment, that the present invention significantly improved long term productivity of treated formations when judged against the results yielded by conventional fracturing methods. The process was then offered for sale to well operators. The applicant continued to execute confidentiality agreements with the operator to prevent any public disclosure of the invention.

G. Dendritic Fracture

Another well was selected. The same amount of fluid was used as before but three injection periods were used. At the start of the third injection period, even with higher pressure the injection rate was much lower.

Then after a period of injection the pressure broken to a lower value and the rate of injection increased. No frac sand was used in this well. After the job was completed the well flowed back about ½ the treating fluid in the same manner that the others had. However, gas appeared at the surface during swabbing operations much sooner than previous wells. The pressure break along with the early gas production indicated a change in direction of the fracture, as will now explain.

Figure 5:
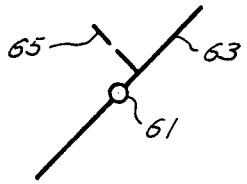
FIGS. 5, 6 and 7 are schematic plan views of dendritic fracture systems in accordance with the invention.

It is applicant's belief that when the pumps are started the third time, fluid flow in the fracture causes the debris formed by crushing of the spalls formed during the first shut down period that moved during the second fluid injection period to move forward where they bridge against the chips or spalls that have just been formed by the second shut down. This causes a sandout at the end of the primary fracture. Pressure now increases until a new fracture starts at a weak point of the fracture wall. Since the rock is now under stress perpendicular to the fracture direction, a new or secondary fracture will propagate in a direction approximately perpendicular to the primary fracture. The result is a system of fractures as shown in FIG. 5, wherein 61 is the well bore, 63 is the initial or primary fracture, and 65 is the secondary or transverse fracture. To produce a long secondary fracture it will be necessary to proceed with the formation of this fracture wing in the same manner (i.e., two slugs of fluid with suitable shut down periods) as the primary fracture.

Figure 6:
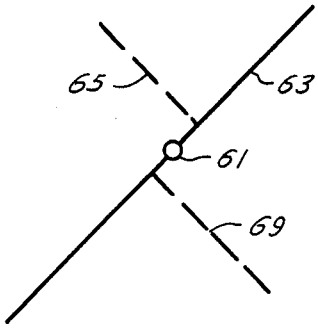
Figure 7:
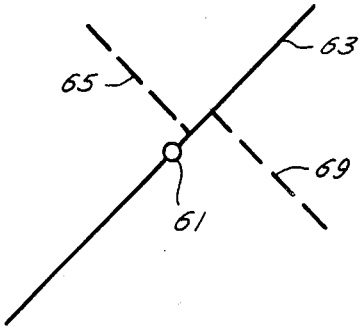
Figure 8:
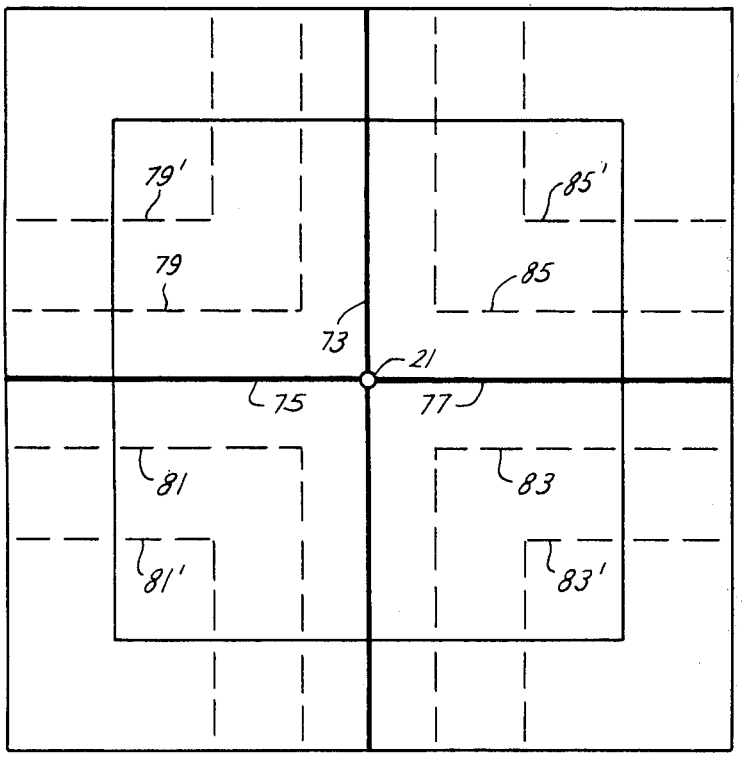
FIG. 8 is a plan view similar to FIGS. 1 and 2 illustrating the transient wave front pattern utilizing the dendritic fracture system, esp. of FIGS. 6 and 7.

As noted in FIg. 5, the secondary fracture, probably, almost surely, will consist of only one wing. However, after completion of the first wing, if the pumps are started once more, there will be a movement of the debris in the single wing transverse fracture causing a sand out thereof and further pumping with suitable shut down periods will extend a fracture wing in the opposite direction from the first secondary wing as shown in FIGS. 7 and 8. The FIGS. 6 and 7 systems are the same as that of FIG. 5 except that in FIG. 6 a second wing 67 on the opposite side of the well from wing 65 has been added, and in FIG. 7 the second wing 69 is added on the same side of the well as the first wing 65. Such a system consisting of a primary fracture and one or more secondary transverse fractures may be called a dendritic fracture system. FIG. 5, then, shows a single wing dendritic system, and FIGS. 6 and 7 show double wing dendritic systems.

The pumping sequence would be like the following to produce the double dendritic fracture system:

pump, wait, pump, wait (primary), pump, wait, pump, wait (first secondary), pump, wait, pump, shut down end (second secondary).

The reason why the dendritic system, which is produced by the above described pumping cycle in accordance with the invention, causes a different, and as will appear, vastly improved well productivity, will next be considered.

Referring now to FIG. 8, there is shown a well bore 21 from which extend a primary fracture 73 and a pair of transverse fractures 75, 77, the latter being shown as collinear in view of the scale of the drawing, it being assumed that they will both be close to the well bore. The pressure waves from the fracture will move out as indicated by the four chevron wave fronts, 79, 81, 83, 85. Subsequent positions of these same wave fronts are shown at 79′, 81′, 83′, 85′.

The four chevron wave fronts shown in FIG. 8 may be treated as eight linear wave fronts, the two linear wave fronts of each chevron front overlapping in their propagation. For each of the eight linear fronts, reservoir engineering theory shows that $$t_D = \sqrt{40}\ \phi u c D^2/_k \qquad (7)$$

and remembering from equation (2) that $T = 20t_D$ so that for T=20 years, $t_D$=1 year, we find that the distance D drained by each of the eight waves in twenty years is $$D_{20}^2 = 57.7\ k/\phi uc \qquad (8)$$

From equation (7) one finds that for the formation having the same constants as previously considered in the case of unfractured and conventionally fractured wells, the distance to which the formation is drained in twenty years by each of the eight linear fronts is 1140 feet.

Assuming as in the case of a long linear fracture previously described that the primary fracture is 3733 feet (the length of one side of a 320 acre or half square mile tract) and that the two wings of the transverse fracture total 3733 feet, the area drained by the dendritic fracture system is 272 acres. This is readily computed as the area of the square of 3733 feet on a side less the area of the four squares not drained by any of the eight linear wave fronts. The equation is $$A = 320 - 4(1866 - D_{20})^2/43560 \qquad (10)$$

where $D_{20}$ as before is the distance drained in twenty years by each of the eight linear wave fronts. The foregoing 272 acres drained by the dendritic fracture system is to be compared with the 54.8 acres drained by a single long hydraulic fracture 3732 feet) in accordance with the invention and the 19 acres drained by a conventional 300 foot linear fracture and the 14.6 acres drainable in 20 years without any fracturing at all.

H. Comparison of Drainage

A comparison of the several fracture systems that gives a further insight into their differences is obtained with reference to the shape of the maximum equal pressure surfaces under steady state conditions of a field of several adjacent wells in which the well spacing is so related to the productivity that the wave fronts reach a maximum distance from the well and then cease to propagate further due to interference from waves from adjacent wells. In the case of unfractured wells, the cylindrical (circular horizontal section) waves from the several wells may ultimately meet and thereafter the maximum equal pressure surfaces may be considered to be overlapping cylindrical surfaces. In the case of linear hydraulic fracturing, parallel wave fronts from adjacent wells may meet and thereafter the maximum equal pressure surfaces are fixed planes (lines in horizontal sections) between the wells. But in the case of dendritic fracturing, the chevron wave fronts from adjacent wells overlap and meet a single vertical line (point in a horizontal section).

I. Natural Joint Systems

A very important advantage of the dendritic system over any linear fracture system results in the enhancement obtained from natural joint systems.

Consider a tight, well consolidated formation. In geologic time it will have developed a joint system that consists of cracks that are more or less cemented that trend in a general direction. The cement in the cracks is probably not as strong as the rock matrix. In addition, the cracks probably have more fluid transmissibility than the rock matrix. There will also be a secondary joint system more or less perpendicular to the major joint system. These are also planes of weakness.

Figure 9:
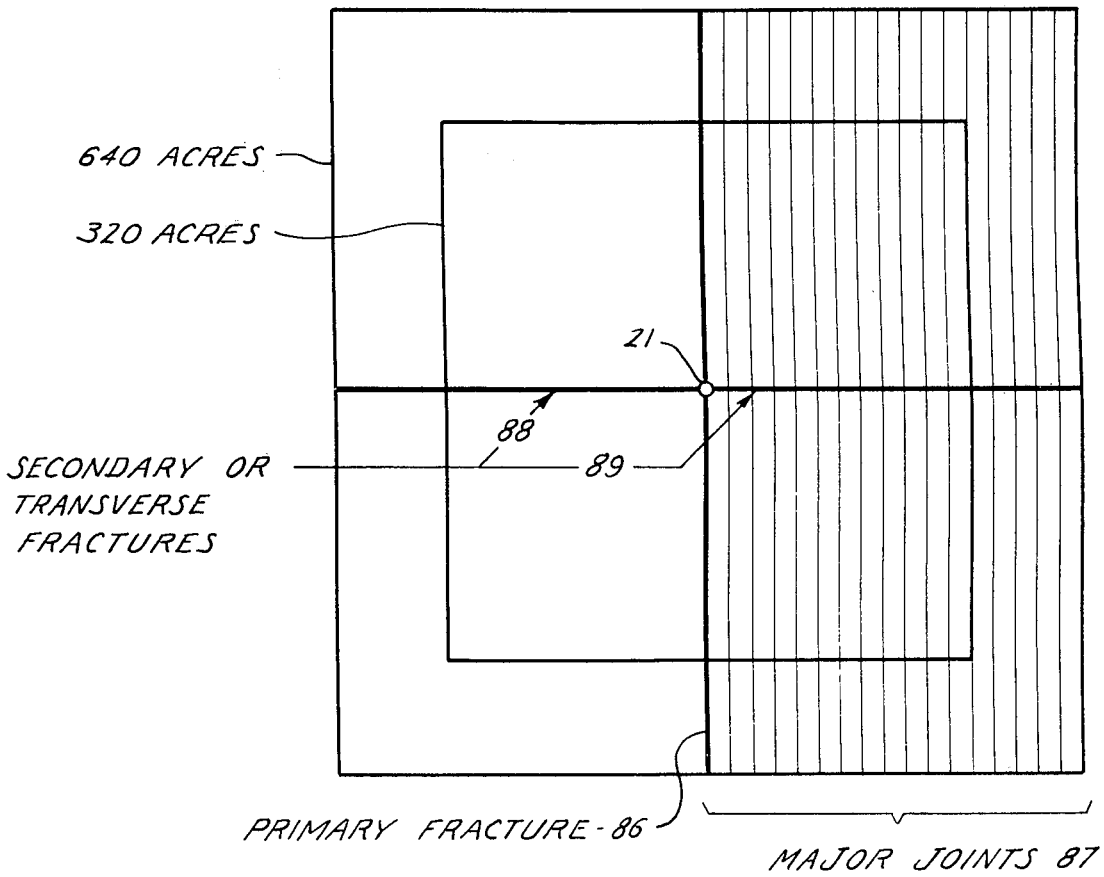
FIG. 9 is a plan view similar to FIG. 8 illustrating another aspect of the invention.

Referring now to FIG. 9, there is shown a schematic diagram similar to FIGS. 1, 2, and 8, showing a plan view of a well bore 21 relative to 320 and 640 acre squares. When a fracturing process as described herein is carried out, the primary fracture 86 probably follows one of the major joints 87. When the secondary fracture system is developed, it will intersect many joints of the major joint system. In addition to the foregoing explanation, the transmissibility of all the joints cut will further aid in rapid recovery of reservoir fluids. The relatively short arrival times for the pressure wave fronts at the 320 and 640 acre perimeters in the case of several assumed permeabilities of the natural joints in millidarcies is charted in the upper left hand quadrant of FIG. 9 such times being calculated as before.

J. Use of Sand: Fluid Loss Control

Figure 10:
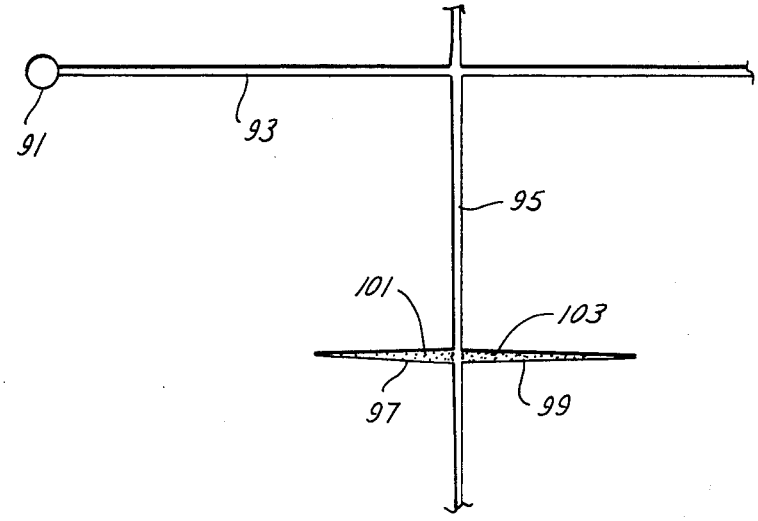
FIG. 10 is a schematic plan view of a stage in the process of creating the dendritic fracture system of the invention.

Depending on the strength of the reservoir rock and the configuration desired for the fracture system, it may or may not be necessary to use a propping agent. In the case of strong rock, self propping is achieved. However, fine sand may be useful for fluids loss control, the fine sand blocking frac fluid from entering into the transected joints. This is illustrated in FIG. 10 whereat is shown well bore 91, primary fracture 93, secondary fracture 95, and joints 97, 99 the latter being blocked off with sand as shown in 101, 103.

There are several reasons to keep the amount of fracturing fluid to a minimum, especially in gas wells. Among these are the actual cost of the fluid and injecting the fluid along with the cost of propping agent. In addition, the well must produce back the fluid injected before it can reach its best potential.

In the dendritic fracturing techniques that have been described hereinabove stimulation is at least partially achieved by utilizing natural joint systems in the reservoir. In massive formations, these joint systems probably extend vertically as well as horizontally throughout the reservoir; (see page 87 of the article entitled "Reservoirs in Fractured Rock", SUPRA.).

The fracture formed in the producing formation may be confined to the upper portion of the producing formation where lithology (overlying rock) will limit the upward growth of the fracture and sand properly scheduled will limit the downward growth of the fracture. When a dendritic fracture system is formed, the joints are intersected that will connect the reservoir both laterally as well as vertically to the fracture system and thus to the well bore. If the vertical extent of the fracture system is limited, as much as 80–90% of the fluid that would be required normally could be saved.

Figure 11:
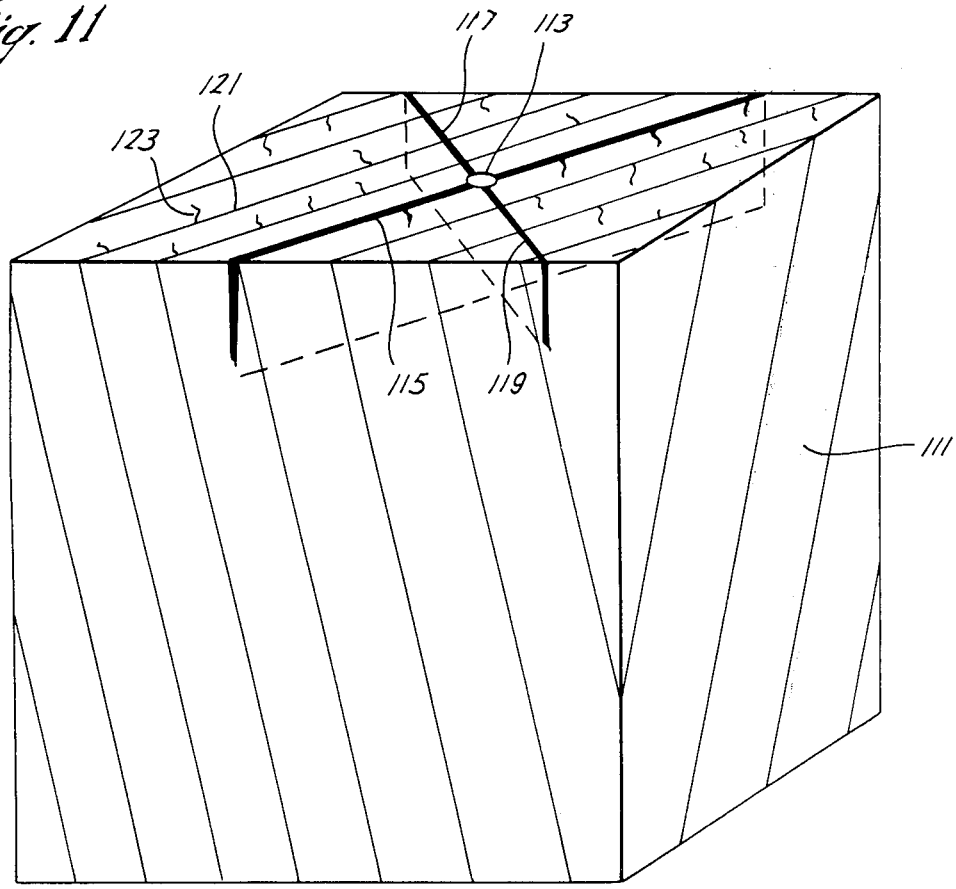
FIG. 11 is an isometric view of a thick sand provided in its upper portion with a dendritic fracture system in accordance with the invention.

The foregoing method of limiting the height of the fracture system is illustrated in FIG. 11, wherein a portion of the producing formation is shown in 111. From the well bore 113 extends the primary fracture 115, extending parallel to or along a natural joint, and secondary fractures, 117, 119 extending transverse thereto. Extending transverse to the natural joints such as 121 are natural transverse joints such as 123. It is these natural transverse joints which are blocked initially by the frac sand to limit loss of frac fluid during the second and third cycles of the fracturing method of the invention. As is apparent from FIG. 10, the frac sand not only blocks too extensive horizontal travel of frac fluid along the natural transverse joints but also limits downward travel of the frac fluid along the primary fracture, the secondary fracture, and the natural primary and secondary joints.

K. Further Historical Comparison

FIG. 12 is a chart prepared from an examination of the frac reports on a group of wells all in the same formation and all in the same general geographical area and all in what is believed to be a very tight formation. The wells were developed as near as the analyst could do so into two groups. In one group were wells wherein for some reason, e.g. mechanical break down of pumping equipment the fracturing procedure was interrupted; in the other group there was no substantial interruption. The productivity of all of the wells was checked from the monthly reports. It appeared that wells wherein the frac process had been interrupted were in many cases of higher productivity than those wherein the frac process was uninterrupted. Averages for the prouctivity of numbers of wells in the group treated by various types of frac treatment are shown in FIG. 12. This is not to imply that in every case the wells with interrupted fracturing produced better than wells similarly treated except for lack of interruption although this may be the case. Also, this is not to imply that such results will be found in the case of groups of wells or individual wells in other areas, although this also may be the case, at least in many instances. It is further to be observed that greater increase in productivity was obtained with interrupted fracturing in the case of visofrac (viscous oil fracturing), and F.W. (fresh water) emulsion and S.W. (salt water) emulsion than in the cases of gelled F.W. and S.W. fracturing; this being due it is believed to the higher viscosity of the oil and emulsion fracturing fluid compound to the gelled water, the higher viscosity resulting in higher fracturing pressures and widths, the greater fracture width allowing more opportunity for spalling when pumping ceases, thereby to obtain the advantages of the invention on resumed pumping as previously explained.

The invention has also been applied but without success to a single offset from three producing gas wells; the result was a substantial dry hole. This is believed to be due to the fact that the fracture did not contact any gas bearing reservoir.

L. Apparatus

The methods of the invention can be carried out by any of the known apparatus used for previously known methods of hydraulic fracturing. A suitable apparatus is shown and described in my aforementioned United States Pat. No. 3,722,595 issued Mar. 27, 1973, the disclosure of which is incorporated herein by reference. My United States Pat. No. 3,378,074 issued Apr. 16, 1968 also shows suitable apparatus and its disclosure is also incorporated herein by reference (the line 39, pump 40 and line 41 may be omitted). The fracturing fluid can be injected through the well tubing, casing, or other available or suitable pipe or conduit and may be flowed back into a pit or into the fracturing fluid tanks. The fluid can be injected through perforations in the tubing or casing extending through the pipe and surrounding outer pipe and/or bore hole annulus cement or directly into the formation, the injection being confined vertically by virtue of the location of the perforations, the pipe, the cement, and the formation above and below the perforation hole. Vertical extends of well pipe of one foot or less to one hundred feet or more are contemplated with respect to injection of fracturing fluid. The pumps used in carrying out the method will normally be positive displacement pumps, with diesel engines or gas turbine device. Shutting down the engine or turbine will hold the pumps stationary and thereby holds back pressure in the well. Reverse flow is normally accomplished through a 2 or 3 inch full opening valve. In an example hereinafter set forth ISIP stands for Instantaneous Shut In Pressure and is the surface pressure existing at zero injection rate.

M. Parameters i. Fracture Fluid

The fracture fluid preferably used in carrying out the method of the present invention desirably is such as to cause little pressure drop in the pipe, maximum pressure in the formation, minimum total fluid loss to the formation, minimum rate of fluid loss to the formation, high carrying capacity for sand or other propping agent with respect to both ratio of sand volume carried to volume of fracture fluid and also distance and time carried, and high and rapid retrieval of fracture fluid when the well is put on production. The fracturing fluid will be substantially incompressible. To a certain extent, some of these factors are related to viscosity, but high viscosity is effective to achieve some results and low viscosity is effective for other purposes. Fluids of time variant viscosity may therefore be used. The viscosity of the injection fluid may range from 30 centipoise or less up to 100 centipoise or more at reservoir temperature. Other factors to be considered include the physical characteristics of the fluid; the fluid is a liquid or gel or emulsion, not usually pure gel. Preferably, the fluids such as those known to the trade as Super Frac and Super Emulsifrac are used. These are described in U.S. Pat. Nos. 3,710,865 - Kiel (emulsion) and U.S. Pat. No. 3,378,074 - Kiel (heavy oil), the disclosure of which are incorporated herein by reference. The Super Emulsifrac fluid is the better of these, especially for gas wells. It is to be observed that in fracturing with water, gelled water, light crude oil, gelled light crude oil, and the like, the pressure ordinarily decreases during the frac job. With the preferred fluids for the present invention, pressure ordinarily increases during the job even when injection rate remains constant. It is to be noted, of course, that pressure drop occurs both in the pipe and the formation; every effort is made to reduce the pressure drop in the pipe and to increase the formation pressure drop up to a point. Therefore fracturing fluids preferred in accordance with the invention may be characterized as formation pressure increasing fluids. It may be surmised that with such fluids, the formation matrix permeability may be temporarily decreased as fluid is injected, thereby causing the formation pressure drop to rise. The effect is to reduce fluid loss, thereby making it practical to have shut down periods in the course of a treatment. In the present invention it is necessary to use a fracturing fluid capable of undergoing limited fluid loss to the formation. The fluid must be capable of permeating the formation matrix as a precurser to spalling when pressure in the fracture is reduced, but the preferred fluid's loss to the joint system of the formation will be as small as possible. In conventional fracturing, when sufficient fluid loss occurs, injecting additional sand blocks the fracture at the well bore causing a sand out. In accordance with the invention, such well sand outs are not to occur.

ii. Pressure

In carrying out the methods of the invention, pressures of 1,000 psi or less up to 15,000 psi or more may be employed, usually about 5,000 psi, the resultant fracture pressure depending on the pump pressure and the well depth and the pressure drops in the pipe and through the fracture.

iii. Injection Time

The injection time depends on the volume of fracturing fluid to be injected, which is determined by how big a fracture is desired and is calculated in advance, and upon the flow rate, which depends on the pressure and flow resistance. The minimum injection time preferably is on the order of several minutes. The time for the entire treatment typically may be one hour or less to eight hours or more.

The total injection time will be the sum of the injection times of the several double cycles, that is, the times for the double cycles for each fracture configuration, primary, first transverse, and second transverse. The injection time for each double cycle will be the sum of an initial or first injection time and a following or second injection time. There will be intra-configuration shut down periods between the first an second injections of each double cycle, and there will be inter-configuration shut down periods between each double cycle.

iv. Injection Volume

The division of injection volumes between the several double cycles may be varied. Absent consideration of any distinctions between the several fracture configurations and other factors, one might divide the volume equally between the several double cycles, e.g. ⅓ of the total volume to each double cycle in the case of three double cycles. To take into account fluid loss, one might assume that the total fluid lost is a linear function of the square root of time. On this assumption, it is presently the practice to divide injection volumes between three double cycles in the approximate proportions 10/14/18. However this may change in the light of future experience.

The division of injection volumes between the first injection and second injection of each double cycle may be such that the volume injected during the second injection is about ¼ to ⅓ that injected during the first injection. This is arrived at by considering that it is desirable for the injection pressure during the second injection to rise the same amount above the initial injection pressure during the second cycle as the amount of rise above the initial injection pressure of the first injection that occurred during the first injection cycle.

The total volume of fluid injected may be from 3,000 barrels or less up to 20,000 barrels (42 gallon barrels) or more, preferably three thousand to five thousand barrels.

Since injection times are a function of injection volume, injection times for the several double cycles may also be in the ratio of 10/14/18, and the second injection of each double cycle may take ¼ to ⅓ the time of the first injection. Hence the shortest injection period should be, for example, $60 \times 10/42 \times \frac{1}{4} = 3.6$ minutes, which is on the order of several minutes.

v. Shut Down Time

In determining shut down time, one may make reference to the time required for decrease in shut in pressure. Time for both the intra-configuration and inter-configuration shut down periods has arbitrarily been selected to be such that surface pressure will not decrease more than ⅓ of the amount it increased during the pumping operation. Although shut down time has varied from five minutes or less to an hour or more, five minutes seems to be long enough for spalling to take place. Thus low pressure periods on the order of several minutes appear adequate to practice the present invention.

In accordance with the invention, the well is not commercially produced between injections; this distinguishes the method from simple retreatment of a well and from a double cycle occurring accidentally due to mechanical breakdown in the course of a conventional treatment. Also, in accordance with the invention, the discontinuance of fluid injection in the course of the double cycle is intentional, which further distinguishes such a double cycle from that occuring accidentally due to mechanical breakdown. The period of injection interruption will, of course, normally be much less than the period of commercial production of a well between repeated conventional treatments, which period would be a matter of months or years. The interruption of injection occuring during a double cycle according to the invention may therefore be characterized as scheduled and brief, thereby to distinguish it from accidental interruptions and from the case of retreatment after commercial production.

N. Examples:

EXAMPLE I

The following is an example of an experimental well stimulation treatment carried out in April of 1973 according to the invention. Permission to publish this information has been obtained.

| | |
|---|---|
| Formation Thickness: | 30' |
| Depth: | 7896' to 7926' |
| Materials: | Frac Fluid: Super Emulsifrac (which is an oil water emulsion consisting of 1 part of fresh water and 2 parts of lease condensate or other light hydrocarbon) |
| | Propping Agent: Sand, 100 mesh, 150,000 lb. |
| | 20/40 mesh, 50,000 lb. |
| | * NE (normal emulsifying) agent type: SEM-5 which is quaternary compound, 486 gallons |
| | * Gelling Agent Type: WG-6, which is Guar Gum, 3,000 gallons |
| | pH buffer Type: CW-1, which is monosodium phosphate, 800 pounds |
| Casing: | New, 4½" O.D., from 0' to 8015', weight 10.5 lb. per foot, maximum psi allowable 4,000. |
| Perforations: | ½" diameter, from 7896' to 7926' one shot per foot |
| Displacement pressure: | 2400 psi |
| Breakdown pressure: | 2550 psi |
| Maximum pressure: | 4100 psi |
| Final Shut In: | |
| Instant Pressure: | |
| | 1800 5 minutes |
| | 1850 15 minutes |
| Hydraulic Horsepower: | |
| Ordered | 3000 |
| Available | 3000 |
| Used | 2034 |
| Average Rates in Barrels Per Minute: | |
| Treating | 21 |
| Displacement | 21 |
| Overall | 21 |
| Volumes: | |
| PAD Gal | 126,000 |
| Treatment Gal | 48,000 |
| Displacement Gal | 6,000 |
| Total Vol. Gal | 189,000 |

*See U.S. patent number 3,760,881 issued September 25, 1973 on application Serial Number 263081.

| Event No. | Time | Rate (bpm) | Volume (GAL) (INCREMENTAL VOLUME) | Pumps C | Pressure (psi) (Casing) | Description of Operation and Materials |
|---|---|---|---|---|---|---|
| | | | | | | Safety Meeting - Discuss Procedure With All Concerned. |
| 1 | 1018 | 26 | 20,000 | 6 | 0 | Start Pad - Load Hole |
| 2 | 1025 | 4 | P | 1 | 5000 | Test Lines |

-continued

| Event No. | Time | Rate (bpm) | Volume (INCREMENTAL VOLUME) | (GAL) Pumps C | Pressure (psi) (Casing) | Description of Operation and Materials |
|---|---|---|---|---|---|---|
| 3 | 1031 | 4 | A D | 1 | 2550 | Breakdown |
| 4 | 1048 | 24 | 4,000 | 4 | 3900 | Start No.4 No. 1 Sand |
| 5 | 1053 | 24 | 2,000 | 4 | 3800 | Start Pad |
| 6 | 1054 | 24 | | 4 | 3800 | No.4 No. 1 On Formation |
| 7 | 1055 | 24 | 4,000 | 4 | 3800 | Start No.4 No. 1 Sand |
| 8 | 1058 | 24 | | 4 | 4000 | Pad On Formation |
| 9 | 1059 | 21 | 2,000 | 4 | 4000 | Start Pad |
| 10 | 1101 | 24 | | 4 | 3950 | No.4 No. 1 On Formation |
| 11 | 1101 | 24 | 4,000 | 4 | 3950 | Start No.4 No. 1 Sand |
| 12 | 1105 | 18 | | 4 | 3975 | Start Flush |
| 13 | 1106 | 21 | 6,000 | 4 | 3975 | Start Flush |
| 14 | 1107 | 26 | | 4 | 3950 | No.4 No. 1 On Formation |
| ** 15 | 1113 | | | | | ISIP 2200 - 5 Min. 2000 - 15 Min. 1800 |
| 17 | 1127 | 24 | | 4 | 4000 | Start Pad |
| 18 | 1136 | 24 | 4,000 | 4 | 4000 | Start No. 4 20/40 Sand |
| 19 | 1141 | 21 | 6,000 | 4 | 3700 | Start Flush |
| 20 | 1142 | 26 | | 4 | 3400 | No.4 20/40 On Formation |
| 21 | 1147 | 24 | | 4 | 3900 | Shut down |
| ** 22 | 1147 | | | | | ISIP 2250 - 5 min. 2100 - 15 Min. 1900 |
| 23 | 1202 | 26 | 20,000 | 4 | 3800 | Start Pad |
| 24 | 1223 | 21 | | 4 | 4000 | Start No.4 No. 1 Sand |
| 25 | 1228 | 21 | 2,000 | 4 | 3900 | Start Pad |
| 26 | 1230 | 26 | | 4 | 3700 | No.4 No. 1 On Formation |
| 27 | 1230+ | 21 | 4,000 | 4 | 3750 | Start No.4 No. 1 Sand |
| 28 | 1234 | 17 | | 4 | 4000 | Pad on Formation |
| 29 | 1235 | 24 | 2,000 | 4 | 4000 | Start Pad |
| 30 | 1237 | 24 | | 4 | 4000 | No.4 No. 1 on Formation |
| 31 | 1239 | 18 | 4,000 | 4 | 4000 | Start No.4 No. 1 Sand |
| 32 | 1241 | 18½ | | 4 | 4000 | Pad On Formation |
| 33 | 1243 | 24 | 6,000 | 4 | 4000 | Start Flush |
| 34 | 1244 | 27 | | 4 | 4000 | No.4 No. 1 On Formation |
| 35 | 1249 | 22 | | 4 | 4000 | Shut Down |
| ** 36 | 1249 | | | | | ISIP 2400 - 5 Min. 2200 - 15 Min. 2100 |
| 37 | 1306 | 25 | 8,000 | 4 | 4000 | Start Pad |
| 38 | 1313 | 20 | 4,000 | 4 | 4000 | Start No.4 20/40 Sand |
| 39 | 1319 | 23 | 6,000 | 4 | 3800 | Start Flush |
| 40 | 1320 | 26 | | 4 | 3600 | No.4 20/40 On Formation |
| 41 | 1325 | 23½ | | 4 | 4000 | Shut Down |
| 42 | | | | | | ISIP 2450 - 5 Min. 2300 - 15 Min. 2200 |
| 43 | 1340 | 24 | 20,000 | 4 | 4000 | Start Pad |
| 44 | 1402 | 20 | 4,000 | 4 | 4000 | Start No.4 No. 1 Sand |
| 45 | 1408 | 27 | 2,000 | 4 | 3800 | Start Pad |
| 46 | 1410 | 24 | | 4 | 3800 | No.4 No. 1 On Formation |
| 47 | 1410 | 24 | 4,000 | 4 | 3800 | Start No.4 No. 1 Sand |
| 48 | 1414 | 19 | | 4 | 3900 | Pad On Formation |
| 49 | 1415 | 24 | 2,000 | 4 | 3800 | Start Pad |
| 50 | 1415 | 24 | 2,000 | 4 | 3800 | No.4 No. 1 On Formation |
| 51 | 1417½ | 24 | 4,000 | 4 | 3800 | Start No.4 No. 1 Sand |
| 52 | 1422 | 18 | | 4 | 3900 | Pad on Formation |
| 53 | 1423 | 24 | 6,000 | 4 | 3900 | Start Flush |
| 54 | 1424 | 21 | 6,000 | 4 | 3800 | No.4 No. 1 On Formation |
| ** 55 | 1429 | 19½ | | 4 | 3900 | Shut Down |
| 56 | | | | | | ISIP 2800 - 5 Min. 2300 - 15 Min. 2300 |
| 57 | 1444 | 18 | 8,000 | 4 | 4000 | Start Pad |
| 58 | 1456 | 12 | 4,000 | 4 | 4000 | Start 4lbs. 20/40 Sand |
| 59 | 1502 | 18 | 6,000 | 4 | 3600 | Start Flush |
| 60 | 1504 | 24 | | 4 | 3400 | No.4 20/40 On Formation |
| 61 | 1512 | 12 | | 4 | 2500 | Finish |
| | | | | | | ISIP 1800 30 Min. 1700 |

In connection with the foregoing example, attention is directed to each of the instantanious shut in pressures occurring during the treatment. At event No. 15 the ISIP is 2200 psi, which is normal for the particular area after a conventional treatment. At event No. 22 the ISIP is still only 2250 psi, reflecting greater width in the initial fracture, which has now a much larger connected length but still is only a single fracture. At event No. 36, the ISIP is 2400 psi, indicating a change in fraction direction as previously explained. At event No; 42, the ISIP is 2450 psi, indicating increased fracture width but no new fracture wing. At event NO; 35 the ISIP is 2800 psi, indicative of a new fracture wing. The final ISIP of 1800 at the end of the treatment is with flush water in the hole instead of emulsion; the water being much denser than the emulsion, surface pressure is lower.

EXAMPLE II

The following is another example of an experimental well stimulation treatment carried out in Feb. 11, 1973 in accordance with the invention, the injection being through the tubing. The formation treated is known as the Muddy J. Sand. Permission to publish the information has been obtained.

Allowable Pressure: Tubing 4600 psi Casing 1000 psi
Job Done Down Tubing.
Gas Well
New Well
4½ inch diameter casing.
2½ inch HD tubing.
Tubing Depth: 2230 feet
Baker packer.
Packer depth: 2230 feet
Casing Volume Below Packer: 100 ± barrels Tubing Volume: 15 ± barrels
Perforated Intervals: Depth 8083-8117 feet Number of Holes 34

(Note: 24 barrels equal 1000 gallons)
Props and Liquids Injected: 100 mesh sand, 144000 lb. 20/40 mesh sand, 48000 lb.

| Time | INJECTION Rate | Bbls In | PRESSURE Csg. | Tbg. | SERVICE LOT |
|---|---|---|---|---|---|
| | | | | | Hook up — Mix chemicals. |
| | | | | | Hook up to well. |
| 12:00 | | | | | Suspend operations — Not enough time for job completion |
| 6:00 | | 2-22-73 | | | Resume operations — Complete hook up. Hold safety meeting & discuss procedures. |
| | | | | | Test connections—Repair leaks—Load & press. csg. |
| 8:30 | | | 1000 | | Start K-1 Pad |
| | | 86 | 1000 | 1500 | Hole loaded—breakdown. |
| | 11 | | 1000 | 1800 | Ftm. feeding—Improve rate & press. |
| | 22 | | 1000 | 4600 | Adjust rates in observance of max. press. |
| | 19 | 480 | 1000 | 4600 | Start 100 mesh sand 4lbs./gal. |
| | 22 | 592 | 1000 | 4200 | Stop sand—start K-1 spacer. |
| | 19 | 640 | 1000 | 4400 | Resume sand at 4lbs./gal. |
| | 21 | 752 | 1000 | 4100 | Stop sand—start K-1 spacer. |
| | 19 | 800 | 1000 | 4300 | Resume sand at 4lbs./gal. |
| | 16 | 912 | 1000 | 4500 | Stop sand — start K-1 flush. |
| | 18 | 1027 | 1000 | 4400 | Flush comp. — S.D. — Observe press. |
| | | | 1000 | 2200 | ISIP |
| | | | 1000 | 1950 | 14 Min. S.D. — Start K-1 pad —Stage II |
| | 18 | | 1000 | 4200 | Rate & Press. Check. |
| | 17 | 1219 | 1000 | 4500 | Start 20–40 Sand 4lbs./gal. |
| | 20 | | 1000 | 3900 | Rate & Press. Check. |
| | 19 | 1329 | 1000 | 4300 | Stop sand — Start K-1 Flush. |
| | 16 | 1446 | 1000 | 4400 | Flush Comp.—S.D.—Observe press. |
| | | | 1000 | 2200 | ISIP |
| | | | 1000 | 1950 | 18 min. S.D.—Start K-1 Pad—Stage III |
| | 19 | | 1000 | 4500 | Rate & Press. Check. |
| | 19 | 1926 | 1000 | 4200 | Start 100 mesh sand 4lbs./gal. |
| | 15 | 2040 | 1000 | 4600 | Stop sand — Start K-1 spacer. |
| | 16 | 2088 | 1000 | 4400 | Resume sand at 4lbs./gal. |
| | 16 | 2198 | 1000 | 4300 | Stop sand—Start K-1 spacer. |
| | 17 | 2246 | 1000 | 4500 | Resume sand at 4lbs./gal. |
| | 19 | 2356 | 1000 | 4000 | Stop sand — Start K-1 flush. |
| | 18 | 2471 | 1000 | 4300 | Flush comp. — S.D.—Observe press. |
| | | | 1000 | | 7 min. S.D. — Start K-1 pad—Stage IV |
| | 16 | | 1000 | 4400 | Rate & press. check. |
| | 18 | 2663 | 1000 | 4600 | Start 20-40 sand 4lbs./gal. |
| | 18 | 2773 | 1000 | 4600 | Stop sand — Start K-1 flush. |
| | 18 | 2888 | 1000 | 4500 | Flush comp. — S.D. — Observe press. |
| | | | 1000 | 2350 | ISIP |
| | | | 1000 | 2250 | 9 min. S.D.—Start K-1 pad—Stage V |
| | | | 1000 | 4600 | Press. & rate check. |
| | 18 | 3368 | 1000 | 4500 | Start 100 mesh sand 4lbs./gal. |
| | 20 | 3478 | 1000 | 4100 | Stop sand—Start K-1 spacer. |
| | 20 | 3526 | 1000 | 4320 | Resume sand at 4lbs./gal. |
| | 18 | 3636 | 1000 | 4600 | Stop sand — Start K-1 spacer. |
| | 20 | 3684 | 1000 | 4100 | Resume speed at 4lbs./gal. |
| | 16 | 3794 | 1000 | 4500 | Stop sand — Start K-1 flush. |
| | 19 | 3909 | 1000 | 4600 | Flush comp.—S.D.—Observe press. |
| | | | 1000 | 2500 | ISIP |
| | | | | | 12 min. S.D. — Start K-1 pad — Stage VI. |
| | 18 | | 1000 | 4200 | Press. & rate check. |
| | 20 | 4101 | 1000 | 4600 | Start 20–40 sand 4lbs./gal. |
| | 21 | 4211 | 1000 | 4100 | Stop sand — Start K-1 flush. |
| | 19 | 4281 | 1000 | 4200 | Start $H_2O$ flush. |
| 2:05 PM | 24 | 4336 | 1000 | 3900 | Flush comp. S.D. — Job Completed |
| | | | 1000 | 2100 | ISIP |
| | | | 1000 | 1500 | 30 min. ISIP |

Fluid: Superfrac K-1
Maximum Pressure: 4600 psi
Average Pressure: 4500 psi
Final pump in pressure: 3900
Adjusted Injection Rate (solids included) 18 barrels/-min.
Total Fluid Pumped: Oil 2365 barrels Water 1335 barrels Well tests performed on the well of Example II showed a fracture conductivity of 120,000 millidarcy inches. From experience with other wells not treated according to the invention, the applicant would expect that under the closure stress existing in the well, a fracture ¼ inch wide fully packed with 100 mesh sand (the sand used in the example) would have a flow capacity of about 1500 millidarcy inches. See "Conductivity of Fracture Proppants in Multiple Layers" by C. E. Cooke, Jr., pp. 1101 et seq, Journal of Petroleum Technology, September 1973.

EXAMPLE III

The following is a further example of an experimental well stimulation treatment carried out in August of 1973. Permission to publish this information has been obtained.

Formation: J-Sand
Well Type: Gas, Workover
Casing: New, 4½ inch diameter, from 0 to 7890 feet, 10½ lb./foot, 4300 maximum allowable psi.
Perforations: 7788 to 7856 (15 holes) 7787 to 7793 (1 shot per foot) 7804 to 7856 (1 shot per foot)

Materials:

Treating Fluid: Super-Emulsifrac
Displacement Fluid: Super Emulsifrac
Prop: 100 mesh sand - 75,000 lb.
and 20/40 mesh sand - 75,000 lb.
Acid Type: HCL - 500 gal., 15%
Surfactant: SEM-5 (300 gal.)
NE Agent: 11-N (3gal.)
Gelling Agent: WG-6 3500 lb.
Breaker: CW-1 800 lb.
KCL 234 sacks
NF-1 60 quarts
(See example I for identification of the coded materials.)

Pressures (in PSI)

Displacement: 3600
Breakdown: 1400
Average: 4000
Shut In Instant: 2900

HYDRAULIC HORSEPOWER

Ordered: 2500
Available: 3000
Used: 1765

RATES (IN BPM)

Treating: 18
Displacement: 18
Overall: 19

Volumes

| | |
|---|---|
| Preflush | 10,500 gal. |
| PAD | 132,000 gal. |
| Treatment | 390,000 gal. |
| Displacement | 5,400 gal. |
| Total Volume | 186,900 gal. |

| Event No. | Time | Rate (rpm) | Volume (GAL) (INCREMENTAL VOLUME) | Pumps C | Pressure (psi) (Casing) | Description of Operation and Materials |
|---|---|---|---|---|---|---|
| | 0945 | | | | | Safety Meeting |
| | | 3 | 500 | 1 | 400 | Pump Acid |
| | 1010 | | 10,000 | | 400 | Start Prepad Load Hole |
| | | | | | | Test Lines |
| | 1027 | 4 | | | 1400 | Breakdown |
| 1 | 1041 | 22½ | 14,000 | 5 | 3700 | Start Pad |
| 2 | 1056 | 22 | 2,000 | 4 | 3950 | Start 1⅓ lbs. 20/40 & 2½ lbs. 100 Mesh Sand |
| 3 | 1058 | 22 | 3,000 | 4 | 3950 | Start Spacer |
| 4 | 1102 | 22 | 2,000 | 4 | 4000 | Start 1⅓ lbs. 2½ lbs. as in event 2 |
| 5 | 1104 | 20½ | 3,000 | 4 | 4000 | Start Spacer |
| 6 | 1107 | 21 | 3,000 | 4 | 4000 | Start 1⅓ lbs. & 2½ lbs. |
| 7 | 1110 | 21 | 3,000 | 4 | 3950 | Start Spacer |
| 8 | 1114 | 21 | 3,000 | 4 | 3900 | Start 1⅓ lbs. & 2½ lbs. |
| 9 | 1117 | 20 | 5,400 | 4 | 3950 | Start Flush |
| *10 | 1124 | 19 | | 4 | 4000 | Shut Down ISIP 2700 |
| 11 | 1139 | 20 | 7,600 | 4 | 4000 | Start Pad |
| 12 | 1150 | 19 | 3,000 | 4 | 4000 | Start 1½ lbs. 20/40 Sand |
| 13 | 1155 | 19 | 5,400 | 4 | 3700 | Start Flush |
| 14 | 1200 | 19 | | 4 | 4000 | shut down ISIP 2700 |
| 15 | 1215 | 18 | 15,600 | 4 | 4000 | Start Pad |
| 16 | 1237 | 18 | 2,000 | 4 | 3950 | Start 1⅓ lbs. 20/40 & 2½ lbs. 100 Mesh |
| 17 | 1240 | 20 | 4,000 | 4 | 4000 | Start Spacer |
| 18 | 1244 | 20 | 2,000 | 4 | 4000 | Start 1⅓ lbs. & 2½ lbs. |
| 19 | 1247 | 19. | 4,000 | 4 | 4000 | Start Spacer |
| 20 | 1257 | 18 | 3,000 | 4 | 4000 | Start 1⅓ lbs. & 2½ lbs. |
| 21 | 1255 | 18 | 4,000 | 4 | 4000 | Start Spacer |
| 22 | 1300 | 17 | 3,000 | 4 | 4000 | Start 1⅓ lbs. & 2½ lbs. |
| 23 | 1305 | 20 | 5,400 | 4 | 4000 | Start Flush |
| *24 | 1312 | 17 | | 4 | 4000 | Shut down ISIP 2950 |
| 25 | 1327 | 18 | 7,600 | 4 | 4000 | Start Pad |
| 26 | 1338 | 18 | 3,000 | 4 | 4000 | Start 4 lbs. 20/40 Sand |
| 27 | 1342 | 20½ | 5,400 | 4 | 4000 | Start Flush |
| 28 | 1350 | 15½ | | 4 | 4000 | Shut down ISIP 2900 |
| 29 | 1405 | 18 | 22,600 | 4 | 4000 | Start Pad |
| 30 | 1441 | 12 | 2,000 | 3 | 4000 | Start 1⅓ lbs. & 2½ lbs. (20/40 & 100 Mesh) |
| 31 | 1444 | 16 | 4,000 | 4 | 4000 | Start Spacer |
| 32 | 1450 | 15 | 2,000 | 4 | 4000 | Start 1⅓ lbs. 20/40 & 2½ lbs. 100 Mesh |
| 33 | 1455 | 10 | 4,000 | 4 | 4000 | Start Spacer |
| 34 | 1501 | 11½ | 3,000 | 4 | 4000 | Start 1⅓ lbs. & 2½ lbs. |
| 35 | 1507 | 16 | 4,000 | 4 | 4000 | Start Spacer |
| 36 | 1513 | 13 | 3,000 | 4 | 4000 | Start 1⅓ lbs. & 2½ lbs. |
| 37 | 1522 | 14½ | 5,400 | 4 | 4000 | Start Flush |
| *38 | 1557 | 5 | | | 4000 | Shut down ISIP 3300 |
| 39 | 1611 | 16 | 5,600 | 4 | 3900 | Start Pad |
| 40 | 1616 | 16 | 3,000 | 4 | 3900 | Start 4 lbs. 20/40 Sand |
| 41 | 1620 | 18 | 5,400 | 4 | 3900 | Finish Flush |
| 42 | 1624 | 22 | | 4 | 3900 | Shut down ISIP 2550 |
| | | | | | | Finished |

Again one can note the instantaneous shut in pressures, at events 10 (2700 psi), 24 (2950 psi) and 38 (3300 psi). The latter high ISIP indicates that a new fracture direction has been formed. In this regard it is to be observed, considering a hypothetical cube of formation material, that the stress in the direction perpendicular to one set of parallel vertical faces will usually be different from that in the direction parallel to the other set. Assume that the cube is oriented so that one set of vertical faces is in the direction of minimum formation stress. The initial fracture may be assumed to occur in a direction perpendicular to these faces since this is the direction requiring the least pressure to separate the sides of the fracture. After the fracture has occurred and the fracture has been propped open by dropping the pressure to allow spalling and resumption of high pressure to move the spalls to propping position and sand out the fracture termini, the stress in the formation is changed. The next application of pressure (following the second shut down, during which the sand out occurs) causes a fracture in a different direction because the minimum rock stress is now in a different direction. The result is the dendritic fracture of this invention.

O. Further Comparisons

Figure 13:
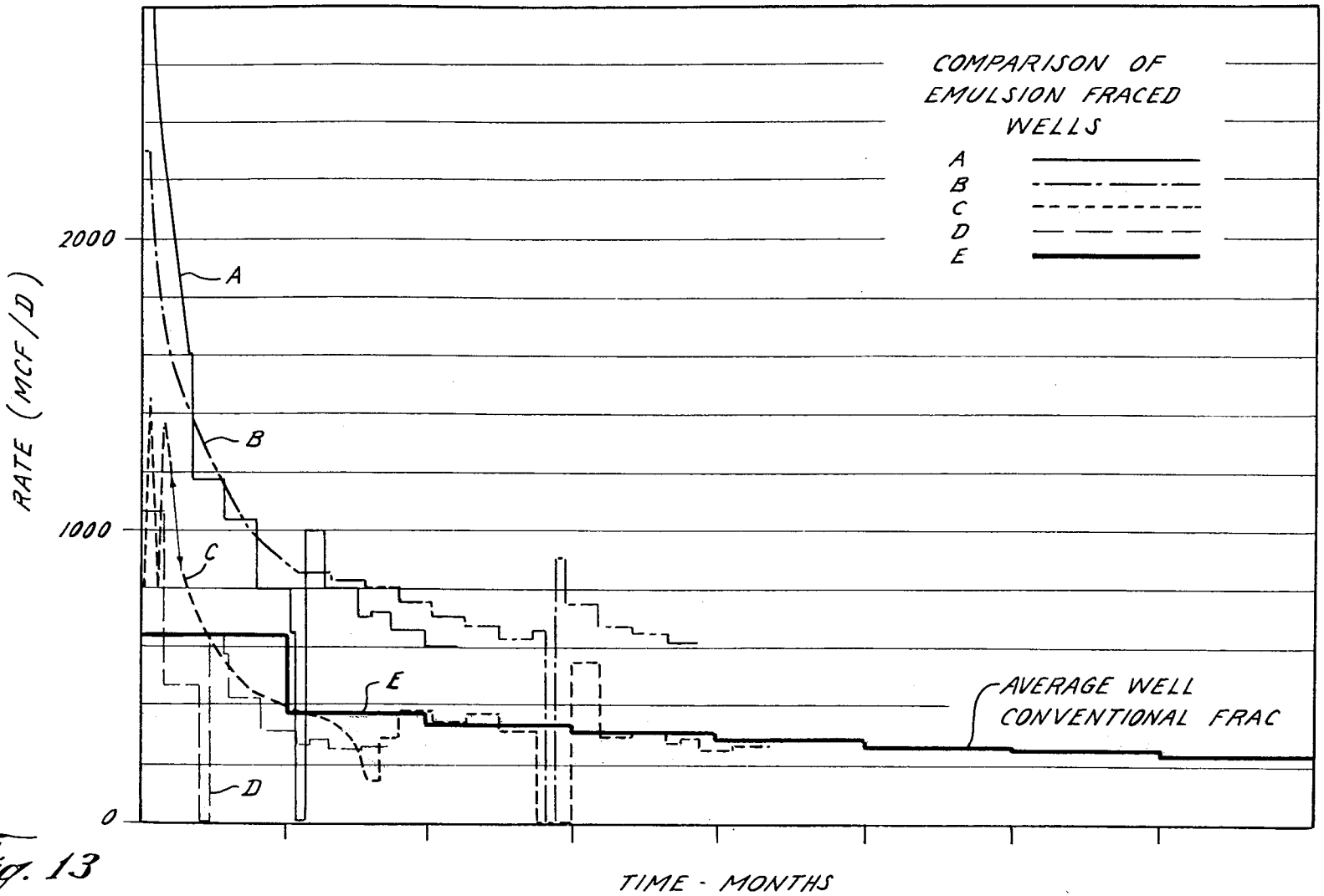
FIGS. 13, 14 and 15 are charts of well productivity.

FIG. 13 is a chart plotting rate of well flow against time for the wells. Continuous line A plots productivity of the best well in this particular field, treated by conventional fracturing methods. Long-short dashed line B plots the productivity of a well treated in accordance with the invention. Short dashed line C plots the productivity of a nearby well treated the same as the well of line B except the fracturing was continuous rather than interrupted. Long dashed line D plots the productivity of another nearby well treated in accordance with the invention and believed to be in a bad sand. The extra heavy continuous line E plots the average for a group of 74 wells, all treated by various conventional fracturing processes. It is seen that line B shows productivity better than the best other well in the group treated conventionally, line A, and far better than the average of conventionally treated wells, line E, and far better than a conventionally treated nearby well using a continuous but otherwise similar fracturing process, line C, and that even in a bad sand (apparently) the well treated according to the invention was of productivity, line D, of not too far from average.

Figure 14:
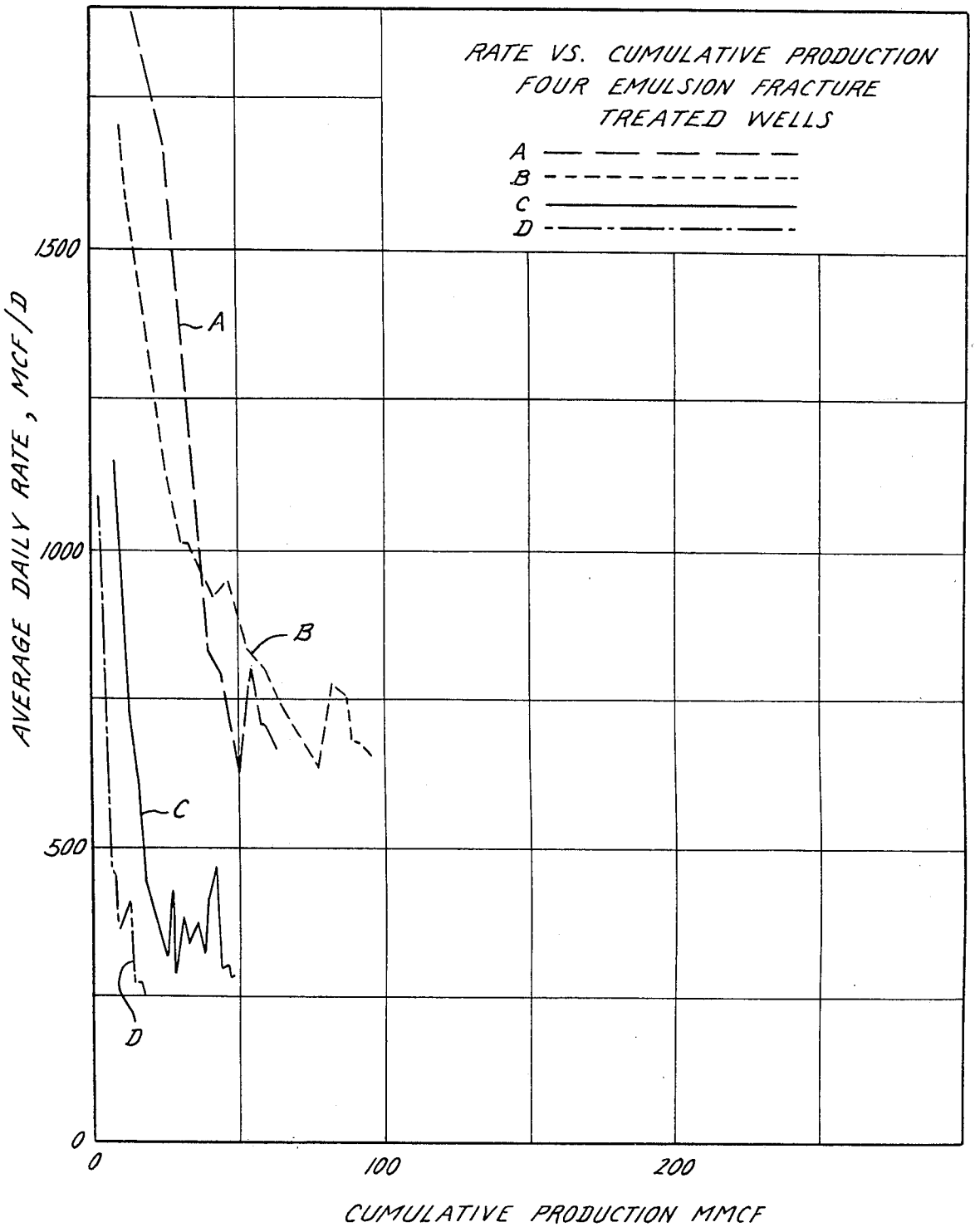

FIG. 14 is similar to FIG. 13 except that it plots against cumulative production instead of time and omits the average line E. These are gas wells, but the invention is equally applicable to oil wells and to HC wells generally.

Figure 15:
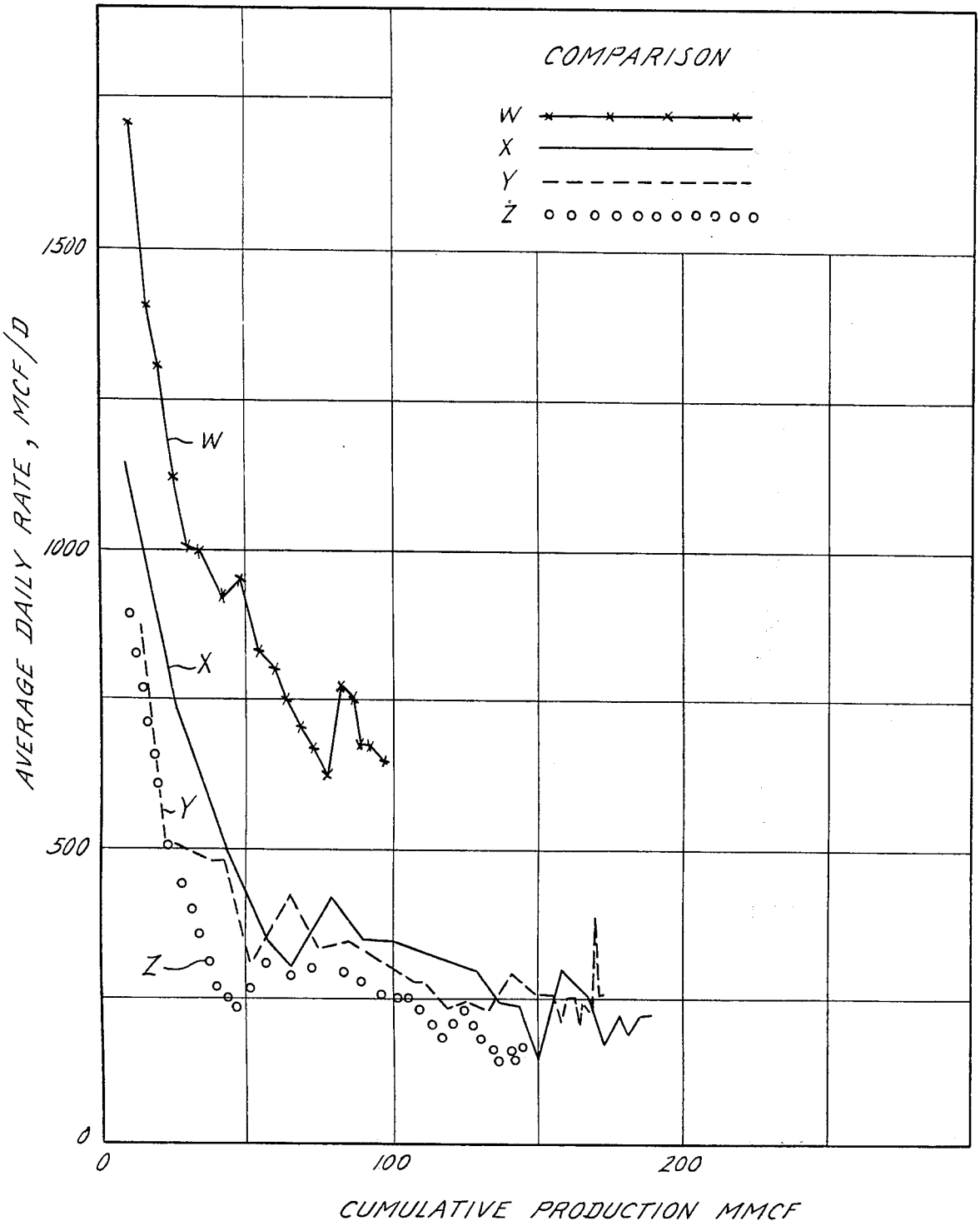

FIG. 15 is another comparative chart similar to FIG. 14, line W being a plot for a well treated according to the invention and lines, X, Y and Z referring to wells treated by conventional fracturing methods.

The above procedure is substantially identical to the method of applicant's copending U.S. application Ser. No. 404,691 which specifically comprises the following:

A. A method of well treatment by hydraulic fracturing of the formation to be treated, said fracturing including at least one double cycle comprising injection of fluid capable of undergoing fluid loss to said formation once said formation is fractured into the formation for a period of at least three minutes under pressure throughout said period sufficient to fracture the formation and planned discontinuance of said fluid injection for a period of time at least long enough to allow a significant pressure drop in said fluid loss from said fracture to the formation, resumption of injection, and discontinuance of injection.

B. Method according to A including two double cycles.

C. Method according to A including three double cycles.

D. Method according to A including a plurality of double cycles.

E. Method according to A including injecting fine sand with the fracturing fluid to limit the vertical conductive extent of the fracturing.

F. Method according to A including injecting fine sand for fluid loss control.

G. A method of well treatment by hydraulic fracturing of the formation to be treated, said fracturing including a plurality of double cycles each of which double cycle comprise:

injecting fracturing fluid capable of undergoing fluid loss to said formation once said formation is fractured into the formation at a pressure sufficient to fracture the formation, maintaining said pressure for at least three minutes, discontinuing injecting fracturing fluid into the formation for a period of time at least long enough to allow a significant pressure drop in said fluid from fluid loss from the fracture to the formation, again injecting fracturing fluid into the formation.

H. Method according to G wherein the number of double cycles is two.

I. Method according to G wherein the number of double cycles is three.

J. Method according to G wherein the well is not produced between double cycles.

K. Method according to G wherein each period of said discontinuing injecting fracturing fluid, except the last such period, lasts for from 5 minutes to one hour.

L. Method according to G wherein the injection pressure during each double cycle subsequent to the first double cycle is significantly greater than during the first double cycle, i.e. is at least 10 per cent greater.

M. Method according to G wherein the period of the even numbered injection is of the order ¼ to ⅓ the period of the immediately preceding odd numbered injection, considering that the several injections are numbered consequently in chronological order.

N. Method of G wherein the periods of the several consecutive pairs of injection periods, considering the first and second injection periods as the first such pair are approximately proportional to the square root of the number of such pair, considering that the several pairs are numbered consecutively in chronological order.

O. Method according to G wherein the periods of discontinuance of injection, other than the last one, are such that the shut in pressure does not fall to less than ⅓ of the amount of the increase in pressure during the previous injection, thereby to avoid excessive fluid loss.

P. Method according to G wherein the fracturing fluid is of the formation pressure increasing type, i.e., if injection were at constant rate, the injection pressure measured at the well head initially increases.

REVERSE FLOW

An improvement of the method specifically described above may be practiced by allowing the well to flow back during at least some portion of the initial period of discontinuation of fluid injection during each double cycle. This reverse flow lowers the pressure in the fracture at a faster rate and to a lower level than does merely shutting the well in and allowing fluid loss from the fracture to the formation to lower fracture pressure. Reverse flow causes a higher rate of pressure change and thus creates a greater pressure differential between the formation and the fracture. This pressure differential causes a higher rate of flow of the fracturing fluid across the fractureformation interface. The higher differential pressure and flow rate generates correspondingly higher earth stresses on the fracture face and produces more spalls than does the shut in method described above. Reverse flow during the second period of discontinuation of injection during each double cycle may not be necessary or desirable, except of course to produce the well at the end of the treatment.

FLUID LOSS AND SPALLING

In the present invention fracturing fluid flows into the rock matrix surrounding the fracture. The fluid pressure in this adjacent matrix is thus increased over formation pressure. When the hydraulic pressure in the fracture is lowered, eg. by reverse flow, below the matrix pressure, then the fracturing fluid in the matrix flows back into the fracture. This fluid flow creates earth stresses at the formation face and adjustment of these earth stresses produces spalls.

The amount of earth stresses produced by the present invention is a direct function of the pressure differential between the matrix and the fracture. Thus a rapid drop in fracture pressure, such as is accomplished by reverse flow, generates high earth stresses on the fracture face and produces large amounts of spalls.

As the relatively incompressible hydraulic fluids that are used in the preferred embodiment of the present invention form a fracture, there are two ways the fluid can leak off.

The first way is for the fluid to permeate the matrix of the rock being fracture, ie to be absorbed into the bulk porosity of the rock where almost all of the reservoir fluids are stored.

Secondly, the fluid will leak off into the natural, ie main and conjugate, joint or fracture system of the formation. In a gas reservoir where the compressability of the reservoir fluid is high, fracturing fluid leak off is controlled by either viscous forces ($C_V$) or by wall building ($C_W$) effects of the fluid loss additives. For low permeability (ie less than 0.5 md) rock, viscous forces will probably be the controlling factor.

According to reservoir theory:

$$C_r = .00148 \sqrt{\frac{\phi k \Delta P_f}{\mu}} \text{ (ft/min}^{1/2}\text{)}$$

where:

$\phi$ = formation porosity (a fraction)
$k$ = permeability to fracturing fluid (md)
$P_f$ = filtration pressure (Fracture Gradient X Depth) + fracture friction of fluid - Formation Fluid Pressure)
$\mu$ = viscosity of fracturing fluid at reservoir temperature. (centipoise).

When the value of $C_v$ as calculated by the above equation is of the order of 0.01 to 0.001, then fluid leak off can be considered to be at a minimum. Even when this is the case, however, some fluid leak off takes place. For example if: (Example One)

$k = .05$; $\phi = .08$; $P_f = 3000$ and $u = .5$, then $C_r = .007$.

This is a low enough rate of fluid loss to be considered minimal, but is still high enough to practice the present invention.

The other type of fluid loss that is encountered in fracturing is loss into the porosity that makes up the natural joint or fracture system that is part of the reservoir before it undergoes hydraulic fracturing. As fracturing fluid starts to enter a natural joint it has a tendency to increase its width (open the joint).

Thus the fracture permeability $K_f = 54.4 \times 10^9 \times (W)^2$ (in md) where W is the fracture width in inches. See Frick, Petroleum Production Handbook, ch 23, p 18.

The quantity (Q) of fracturing fluid lost to 1000 joints each having a width of .01 inches, a length of 83 feet, and a height of 40 feet can be calculated by the formula:

$$Q = \frac{nAk\Delta P}{ul} \times .00038$$

where:

$n$ = the number of joints
A = surface area of the joint (in cm²)
$k_f$ = perneability of the joint (in darcies)
$u$ = viscosity of the fracturing fluid at reservoir temperature (in deg. C)
1 = length of the joint (in cm)
$\Delta P$ = pressure drop across 83 feet (atmospheres)

For the values of u used in example one, above, and capable of being used in the present invention, this equation yields a loss of 100 barrels of fracturing fluid per minute to the natural joint system of the formation.

Thus it is seen that fluid loss to the joints must be controlled to properly practice the invention. Accordingly, the fracturing fluid used should allow minimum fluid loss to the formation, but must allow some fluid loss to the matrix to produce spalls. Also fine (100 mesh) sand may be used to control fluid loss to the joint system. This fine sand has a permeability of about 10–12 darcies (10,000 12,000 md) at a closure stress of 3–4,000 psi. This allows sufficient flow capacity when the well is put on production, but does not allow excessive fluid loss during fracturing.

During fracturing operations fluid loss to the matrix causes a transient pressure wave to form in the matrix. Pressure at the fracture face is a function of (fracture gradient × Depth) + fracture friction. Pressure at the leading edge of the transient wave is formation pressure.

When the pumps are shut down, pressure at the fracture face is reduced by the amount of the fracture fluid friction. This reduction has a tendency to cause the fracture face to spall due to the adjustment of earth stresses resulting from the flow of fluid out of the matrix into the lower pressure of the fracture. Any further reduction in fluid pressure should result in greater tendency for the formation face to spall. However, the rate of spalling is a function not only of the decrease in pressure in the fracture, but also of the rate of pressure decrease. High rates of pressure decrease act to maximize earth stresses acting on the formation face and thus maximize the production of spalls.

Conversely, if pressure in the fracture decreases at a rate slow enough so that fluid from the matrix can flow into the fracture without generating earth stresses at the fracture face, spalling will be minimized.

FLOW BACK

It has been found that if, after the pumps are shut down, instead of waiting for the fracture pressure to decrease by fluid leakoff to the joint system, a valve (as large as possible, normally a 1 inch to 3 inch full opening valve) is opened at the surface, a higher rate and greater absolute value of fracture pressure reduction will result than can be achieved by merely shutting in the well and waiting for the fracturing fluid to leak off via natural joints.

Experimentation has show that this reverse flow technique results in a greater drainage area (ie longer fractures) and higher flow rates (ie greater flow capacity) than is otherwise attainable.

Experience on flow back (reverse flow) time has varied from as high as 5 minutes or more to down to 30 seconds. The five minutes is probably longer than necessary for no better result is obtained with the increase of time. Since a finite time is required to open and close a valve controlling 1,000–3,000 psi of fluid pressure, it has not been possible to use a reverse flow period of less than 30 seconds, although a shorter period may well be capable of practicing the present invention.

The normal sequence of a fracture treatment according to the preferred embodiment of the present invention is as follows:

1. pump, stop, flow back, pump, stop, shut in.
2. pump, stop, flow back, pump, stop, shut in, and repeat.

It is not known whether a flowback period during the shut in period would be beneficial or not. However, a flowback period at that time is within the scope of the present invention.

In multizone reservoirs a variation of the above sequence has been used to insure that all zones are fractured. Assume that each step is performed as above. The multizone fracturing job will go as follows:

1. steps 1 through 8 above.
2. pump and place larger sand.

In some cases the flow back has been routed into a 1000 gal tank to measure rate of flow back. During the first flow back period it took as long as 3–4 minutes for the 1000 gal tank to fill. The second flow back period filled the tank in 1 to 1.5 minutes and the third required 30 seconds or less. The decrease in time required to flow back during subsequent periods indicates an increase in flow capacity of the fracture system.

At other times, where small tanks were not available, the well was flowed back either into a pit or into one of the fracturing tanks. In the pit, the increase in flow rate between flow back periods was observable; in the fracturing tank it was audible.

EXPERIMENTAL USE

Applicant first practiced the present invention using reverse flow experimentally in April 1974.

As was described above, applicant is paid to perform well treatments that include fracturing operations. During fracturing operations, applicant practices the present invention's reverse flow method in an experimental program to develop data that will allow the applicant to determine if the reverse flow method will result in long term production increases and longer fractures having greater conductivity compared to fracturing methods taught by the prior art.

Applicant has taken steps to preserve the security and confidentiality of the reverse flow method herein described. These steps include, but are not limited to, the execution of secrecy agreements with the operators and contractors the applicant works with when treating oil and gas wells. The agreements further provide that production data must be made available to the applicant and that applicant may limit the personnel on the rig where performing secret experimental work.

The applicant offers a fracturing service including shut-in-multiple fracturing (conventional results are used for comparison). Concurrently, with these treatments applicant experiments with the present reverse flow method. This is the only way applicant can perform experiments. The expenses of experimental fracturing operations rule out experimentation in the field by private inventors, except as part of a commercial program. To allow quantitative assessment of the treatment, it is necessary that the experiments be performed on producing formations having known histories. Such formations are only available for experimental use when they have been treated with commercial fracturing operations.

The present invention is still in the experiment stage and it is anticipated that, due to the nature of the art as discussed above, up to a year of further experimentation will be necessary before the applicant has developed sufficient data to determine the limits and potential of the present reverse flow method. Preliminary results, however, indicate that use of the present method yields significantly higher long term recovery and thus better fracturing and higher permeability than is possible using conventional or shut-in-multiple fracturing.

EXAMPLE IV

The following is an example of an experimental well stimulation treatment carried out in April of 1974 using reverse flow according to an embodiment of the present invention. Permission to publish this information has been obtained.

| | |
|---|---|
| Formation Thickness: | 15' |
| Depth: | 4405' to 4416' |
| Type of service: | Experimental Frac. Process |
| Casing: | 5½" |

-continued

| | |
|---|---|
| Tubing: | 2" |
| Job done down annulus | |
| Gas well | |
| Oil well | |
| Maximum allowable pressure: | 3,000 psi |
| Average Pressure: | 2,500 psi |
| Final pump in pressure: | 2,300 psi |
| Props & liquids injected: | |

| Type | Size | Amount |
|---|---|---|
| OKLA No.1 | 100 (Sand) | 40,000 lbs. |
| SAND | 20–40 | 12,000 lbs. |
| J133 | (Guar Gum) | 300 lbs. |
| U-78 | (Emulsifier) | 100 gal. |
| Adamite Aqua | (Fluid loss control Agent) | 500 lbs. |

| | |
|---|---|
| Average liquid injection rate: | 17 bpm |
| Approximate formation permeability: | .003–.01 md. |

| Event No. | Time | INJECTION Rate | Bbls In | PRESSURE Psi | SERVICE LOG |
|---|---|---|---|---|---|
| | | | | | Mix Chem. in Brine Water |
| 1 | 1015AM | | | | Test Lines Tl 3000 psig |
| 2 | 1042 | 15 | | 0 | St. 5000 Gal. Pad w/13 lbs./1000 Ad. Aqua down An. |
| 3 | 1044 | 15 | 30 | 2200 | 30 Bls. Pad in Anulus Loaded Pump in Form. |
| 4 | 1050 | 15 | 119 | 2500 | Pad in St. 2000 Gal. w/Okla. No. 1 Sand at 2 lbs. Pr. Gal. |
| 5 | 1054 | 15 | 166 | 2400 | St. 2000 Gal Pad |
| 6 | 1057 | 15 | 214 | 2400 | St. 2000 Gal w/Okla. No. I Sand at 3½ lbs. Pr. Gal |
| 7 | 1100 | 15 | 262 | 2300 | St. 3500 Gal. Pad w/13 lbs./1000 Ad. Aqua |
| 8 | 1106 | | 347 | 1300 | Pad in Shut Down 5 min. ISIP 1300 |
| 9 | 1111 | 15 | | 2250 | St. 3500 Gal Pad w/13 lbs./1000 Ad. Aqua |
| 10 | 1114 | | 405 | 1300 | Shut Down 5 Min ISIP 1300 |
| 11 | 1120 | 19 | | 2600 | St. 4000 Gal Pad w/13 lbs./1000 Ad. Aqua |
| 12 | 1125 | 19 | 504 | 2600 | St. 2000 Gal w/Okla. No.1 Sand at 3½ lbs. |
| 13 | 1128 | 19 | 552 | 2600 | St. 2000 Gal Pad |
| 14 | 1130 | 18 | 600 | 2700 | St. 2000 Gal Pad w/Okla. No.1 Sand at 3½ lbs. |
| 15 | 1133 | 18½ | 648 | 2700 | St. 3500 Gal Pad w/13 lbs./1000 Ad. Aqua |
| 16 | 1137 | | 733 | 1300 | Shut Down 5 Min. ISIP 1300 |
| 17 | 1143 | 18 | | 2800 | St. 3500 Gal Pad w/13 lbs./1000 Ad. Aqua |
| 18 | 1144 | | 741 | | Nipple on Well Head Started Leaking Shut Down ISIP 1300 |
| 19 | 1150 | | | | Flow Well Back in Frac Tank |
| 20 | 105PM | | | | 241 Bls. Flowed to Frac Tank |
| 21 | 130 | 4½ | 65 | 500 | Pump 65 Bls. SW down Annulus |
| 22 | 135 | | | | Flow Back & Change Nipple & Valve on Well Head |
| 23 | 205 | 11 | | 1500 | Pump Fluid That Flowed Back To Tank Back in Well |
| 24 | 225 | | 241 | 1250 | Shut Down ISIP 1250 |
| 25 | 250 | 19 | (From 741 Bls.) | 2600 | Cont. Frac St. 3000 Gal. Pad w/13 lbs./1000 Ad. Aqua |
| 26 | 255 | | 816 | 1350 | Shut Down ISIP 1350 Wait on Water |
| 27 | 314 | 21 | | 2900 | St. 2000 Gal w/Ad Aqua 13 lbs./1000 |
| 28 | 325 | 20 | 1034 | 3000 | St. 2000 Gal w/Okla. No.1 Sand at 3½ lbs. |
| 29 | 327 | 20 | 1082 | 2900 | St. 2000 Gal Pad |
| 30 | 329 | 19½ | 1130 | 2900 | St. 2000 Gal w/Okla. No.1 Sand at 3½ lbs. |
| 31 | 332 | 19 | 1178 | 3000 | St 3500 Gal Pad |
| 32 | 337 | | 1263 | 1350 | Shut Down 5 Min ISIP 1350 |
| 33 | 344 | 15½ | | 2400 | St 1500 Gal Pad |
| 34 | 346 | 15½ | 1299 | 2300 | St, 3000 Gal w/20–40 Sand at 4 lbs. |
| 35 | 351 | 15½ | 1371 | 2300 | St. 3500 Gal Salt Water Flush |
| 36 | 357 | | 1456 | 1200 | Flush Complete Shut Down |

Computer analysis of transient flow data from test example number IV and from the test above described in example number III indicates that the effective fracture lengths and conductivities produced by the respective treatments are as shown in the following table:

| Well Example | Effective Frac. Length | Fracture Conductivity |
|---|---|---|
| III | 500 ft. | 120,000 md/in |
| IV | 3500 ft. | 300,000 md/in |

Analysis of test data from wells in similar formations fractured by conventional methods indicates that the conventional methods produce effective fracture lengths of less than 100 feet (usually 30 to 90 feet) and maximum fracture conductivity of from 20,000 to 30,000 md/in.

While a preferred embodiment of the invention has been illustrated and described, modifications thereof can be made by one skilled in the art without departing from the spirit of the invention as embodied in the scope of the following claims.

I claim:

1. A method of well treatment by hydraulic fracturing of the formation to be treated, said fracturing including at least one double cycle comprising injection of fluid into the formation for a period of at least three minutes under pressure throughout said period sufficient to fracture the formation; planned discontinuance of said fluid injection and at least one period of reverse flow of said fluid from said formation for a period of time at least long enough to allow a significant pressure drop in said fluid, resumption of injection, and discontinuance of injection.

2. Method according to 1 including two double cycles.

3. Method according to 1 including three double cycles.

4. Method according to 1 including a plurality of double cycles.

5. Method according to 1 incuding injecting fine sand with the fracturing fluid to limit the vertical conductive extent of the fracturing.

6. Method according to 1 including injecting fine sand for fluid loss control.

7. Method according to claim 1 wherein said period of reverse flow is sufficient to return .25 to 1.00 percent by volume, of the fluid injected into the formation.

8. Method according to claim 1 where said period of reverse flow is sufficient to allow flow back of more than five and less than 50 barrels of said fluid.

9. Method accordng to claim 1 wherein said period of reverse flow is greater than 20 seconds and less than 10 minutes.

10. Method according to claim 1 wherein said period of reverse flow is sufficient to allow flow back of less than all recoverable fracturing fluid.

11. Method according to claim 1 wherein said fluid is substantially incompressible.

12. Method according to claim 1 wherein said fluid is gas-free at formation and surface ambiant conditions.

13. Method according to claim 1 wherein said fluid is injected into the formation for at least several minutes.

14. A method of well treatment by hydraulic fracturing of the formation to be treated, said fracturing including a plurality of double cycles each of which double cycles comprises:

injecting fracturing fluid into the formation at a pressure sufficient to fracture the formation, maintaining said pressure for at least three minutes, discontinuing injecting fracturing fluid into the formation, allowing at least one period of reverse flow from said formation for a period of time at least long enough to allow a significant pressure drop in said fluid, and again injecting fracturing fluid into the formation.

15. Method according to 14 wherein the number of double cycles is two.

16. Method according to 14 wherein the number of double cycles is three.

17. Method according to 14 wherein the well is not produced between double cycles.

18. Method accordng to 14 wherein each period of said discontinuing injecting fracturing fluid, except the last such period, lasts for from 5 minutes to one hour.

19. Method according to 14 wherein the injection pressure during each double cycle subsequent to the first double cycle is significantly greater than during the first double cycle, i.e. is at least 10 percent greater.

20. Method according to 14 wherein the period of the even numbered injection is of the order ¼ to ⅓ the period of the immediately preceding odd numbered injection, considering that the several injections are numbered consecutively in chronological order.

21. Method of 14 wherein the periods of the several consecutive pairs of injection periods, considering the first and second injection periods as the first such pair are approximately proportional to the square root of the number of such pair, considering that the several pairs are numbered consecutively in chronological order.

22. Method according to 14 wherein the periods of discontinuance of injection and reverse flow, other than the last one, are such that the shut in pressure does not fall to less than ⅓ of the amount of the increase in pressure during the previous injection, thereby to avoid excessive fluid loss.

23. Method according to 14 wherein the fracturing fluid is of the formation pressure increasing type, i.e., if injection were at constant rate, the injection pressure measured at the well head initially increases.

24. Method according to claim 14 wherein said period of reverse flow is sufficient to return .25 to 1.00 percent, by volume, of said fluid injected into the formation.

25. Method according to claim 14 wherein said period of reverse flow is sufficient to allow flow back of more than 5 and less than 50 barrels of said fluid.

26. Method according to claim 14 wherein said period of reverse flow is greater than 20 seconds and less than 10 minutes.

27. Method according to claim 14 wherein said period of reverse flow is sufficient to allow flow back of less than all recoverable fracturing fluid.

28. Method according to claim 14 wherein said fluid is substantially incompressable.

29. Method according to claim 14 wherein said fluid is gas-free at formation and surface ambiant conditions

30. Method according to claim 14 wherein said fluid is injected into the formation for at least several minutes.

31. Method of well treatment by hydraulic fracturing of the formation to be treated, said fracturing including at least one double cycle comprising injection of fluid into the formation for a period of at least three minutes under pressure throughout said period sufficient to fracture the formation, said fluid being capable of undergoing fluid loss to said formation once said formation is fractured, planned discontinuation of said fluid injection for a period of time at least long enough to allow a pressure reduction in said fluid, resumption of injection with at least a portion of the formation exposed to fluid pressure during the first said injection being the same as a portion of the formation again exposed to fluid pressure during said resumed injection, and discontinuance of injection.

32. Method according to claim 31 including two double cycles.

33. Method according to claim 31 including three double cycles.

34. Method according to claim 31 including a plurality of double cycles.

35. Method according to claim 31 including injecting fine sand with the fracturing fluid to limit the vertical conductive extent of the fracturing.

36. Method according to claim 31 including injecting fine sand for fluid loss control.

37. Method according to claim 31 wherein said injection into the formation of fluid under pressure sufficient to fracture the formation lasts from 3 minutes to one hour.

38. Method according to claim 37 wherein said planned discontinuance of such fluid injection lasts not more than 10 minutes.

39. Method of well treatment by hydraulic fracturing of the formation to be treated, said fracturing including a plurality of double cycles each of which double cycles comprises:

injecting fracturing fluid into the formation at a pressure sufficient to fracture the formation, said fluid being capable of undergoing fluid loss to said formation once said formation is fractured, maintaining said pressure for at least three minutes, discontinuing injecting fracturing fluid into the formation for a period of time at least long enough to allow a pressure reduction, again injecting fracturing fluid into the formation with at least a portion of the formation exposed to fluid pressure during the first said injection being the same as a portion of the formation again exposed to fluid pressure during said resumed injection, and again discontinuing injecting fracturing fluid into the formation.

40. Method according to claim 39 wherein the number of double cycles is two.

41. Method according to claim 39 wherein the number of double cycles is three.

42. Method according to claim 39 wherein the well is not produced between double cycles.

43. Method according to claim 39 wherein each period of said discontinuing injecting fracturing fluid, except the last such period, lasts for from 5 minutes to one hour.

44. Method according to claim 39 wherein the injection pressure during each double cycle subsequent to the first double cycle is significantly greater than during the first double cycle, i.e. is at least 10 percent greater.

45. Method according to claim 39 wherein the period of the even numbered injection is of the order ¼ to ⅓ the period of the immediately preceding odd numbered injection, considering that the several injections are numbered consecutively in chronological order.

46. Method of claim 39 wherein the periods of the several consecutive pairs of injection periods, considering the first and second injection periods as the first such pair are approximately proportional to the square root of the number of such pair, considering that the several pairs are numbered consecutively in chronological order.

47. Method according to claim 39 wherein the periods of discontinuance of injection, other than the last one, are such that the shut in pressure does not fall to less than ⅓ of the amount of the increase in pressure during the previous injection, thereby to avoid excessive fluid loss.

48. Method according to claim 39 wherein the fracturing fluid is of the formation pressure increasing type, i.e., if injection were at constant rate, the injection pressure measured at the well head initially increases.

49. Method of well treatment by hydraulic fracturing of the formation to be treated, said fracturing including at least one double cycle comprising:

injecting into said formation a fluid capable of undergoing fluid loss to said formation once said formation is fractured, continuing said injection for a period of at least three minutes.

at all times during said period maintaining said fluid under a pressure sufficient to fracture the formation.

then dropping the fluid pressure to give an opportunity for spalling to occur at the fracture faces, resuming injection at a time beginning at least three minutes later than the first period of injection, and discontinuing of said injection, at least a portion of the formation exposed to fluid pressure during the first period of injection being the same as a portion of the formation exposed to fluid pressure during the second period of injection.

50. Method of well treatment by hydraulic fracturing of the formation to be treated, said fracturing including at least one double cycle comprising:

injecting into said formation a fluid capable of undergoing fluid loss to said formation once said formation is fractured, continuing said injection for a period of at least three minutes, at all times during said period maintaining said fluid under a pressure sufficient to fracture the formation, discontinuing injection for a period of at least three minutes to give an opportunity for spalling to occur at the fracture faces, resuming injection, and discontinuing injection, the same formation being treated during the entire treatment.

* * * * *